US007950769B2

(12) United States Patent
Sakai et al.

(10) Patent No.: US 7,950,769 B2
(45) Date of Patent: May 31, 2011

(54) CIRCUIT BOARD FOR INK JET HEAD, INK JET HEAD HAVING THE SAME, METHOD FOR CLEANING THE HEAD AND INK JET PRINTING APPARATUS USING THE HEAD

(75) Inventors: Toshiyasu Sakai, Kawasaki (JP); Ichiro Saito, Yokohama (JP); Teruo Ozaki, Yokohama (JP); Sakai Yokoyama, Kawasaki (JP); Takahiro Matsui, Yokohama (JP); Takuya Hatsui, Setagaya-ku (JP); Kazuaki Shibata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1106 days.

(21) Appl. No.: 11/566,958

(22) Filed: Dec. 5, 2006

(65) Prior Publication Data

US 2007/0146428 A1 Jun. 28, 2007

(30) Foreign Application Priority Data

Dec. 9, 2005 (JP) ..... 2005-356314
Sep. 27, 2006 (JP) ..... 2006-262702
Nov. 27, 2006 (JP) ..... 2006-318864

(51) Int. Cl.
*B41J 2/165* (2006.01)

(52) U.S. Cl. ..... 347/22; 347/23; 347/61; 347/63; 347/64

(58) Field of Classification Search ..... 347/61–65, 347/67, 45, 28, 22–23, 19
See application file for complete search history.

(56) References Cited

U.S. PATENT DOCUMENTS 4,723,129 A 2/1988 Endo et al.
4,740,796 A 4/1988 Endo et al.
4,855,763 A * 8/1989 Kan et al. ..... 347/152
5,122,777 A * 6/1992 Shiratsuki et al. ..... 338/306
5,638,100 A * 6/1997 Kanematsu et al. ..... 347/35
6,019,456 A * 2/2000 Onishi et al. ..... 347/57
6,435,660 B1 8/2002 Ozaki et al.
2002/0024564 A1 * 2/2002 Ozaki et al. ..... 347/64
2002/0024565 A1 * 2/2002 Ozaki et al. ..... 347/64
2003/0090547 A1 * 5/2003 Imanaka et al. ..... 347/59
2003/0103111 A1 * 6/2003 Saito et al. ..... 347/56
2005/0078151 A1 * 4/2005 Bell et al. ..... 347/63
2006/0033778 A1 2/2006 Shibata et al.

(Continued)

FOREIGN PATENT DOCUMENTS

JP 9-29985 A 2/1997

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

In an ink jet head using a thermal energy for ejecting ink, this invention aims to reliably and uniformly remove kogations deposited on a heat application portion in contact with the ink. To realize this objective, the upper protective layer is arranged in an area including the heat application portion so that it can be electrically connected to serve as an electrode which causes an electrochemical reaction with the ink. The upper protective layer is formed of a material containing a metal which is dissolved by the electrochemical reaction and which does not form, on heating, an oxide film which hinders the dissolution. With this arrangement, a reliable electrochemical reaction can be produced to dissolve a surface layer of the upper protective layer, thereby removing kogations on the heat application portion reliably and uniformly.

18 Claims, 26 Drawing Sheets

U.S. PATENT DOCUMENTS

2006/0033779 A1 2/2006 Shibata et al.
2006/0061626 A1* 3/2006 Saito et al. ..... 347/58
2009/0315954 A1* 12/2009 Sakurai et al. ..... 347/63
2009/0315956 A1* 12/2009 Ishida et al. ..... 347/63
2010/0123759 A1* 5/2010 Matsui et al. ..... 347/63

* cited by examiner

PRIOR ART

CIRCUIT BOARD FOR INK JET HEAD, INK JET HEAD HAVING THE SAME, METHOD FOR CLEANING THE HEAD AND INK JET PRINTING APPARATUS USING THE HEAD

BACKGROUND OF THE INVENTION

1. Field of the Invention

The present invention relates to an ink jet head to eject ink onto a print medium for printing according to an ink jet method and also relates to a circuit board for the head, a method and a device for cleaning the head and an ink jet printing apparatus using the head.

2. Description of the Related Art

An ink jet printing method disclosed in U.S. Pat. No. 4,723,129 or 4,740,796 can perform a high-speed, high-quality printing by generating a bubble in ink using a thermal energy and can easily be upgraded to have a color printing capability and reduced in size. Because of these advantages, this method has become a mainstream of the ink jet printing method in recent years.

A general construction of the head (ink jet head) used for the ink jet printing comprises a plurality of ink ejection orifices, a plurality of liquid paths communicating to the ink ejection orifices, and a plurality of electrothermal transducers to generate a thermal energy to eject ink from the nozzles. The electrothermal transducer is constructed of a heating resistor and an electrode to supply electricity to the resistor. The electrothermal transducer is covered with an electrically insulating protective layer to secure insulation between the electrothermal transducers. Each ink path communicates with a common liquid chamber which is supplied ink from an ink tank containing ink. The ink supplied to the common liquid chamber is introduced into each liquid path and, near an ink ejection orifice, forms a meniscus which is kept there. In this state, when the electrothermal transducers are selectively driven, they generate a thermal energy which rapidly heats the ink through an ink contact member (heat application portion) situated immediately above the electrothermal transducer, generating a bubble in ink. A pressure of the expanding bubble ejects an ink droplet.

The heat application portions of such an ink jet head (hereinafter simply referred to also as a head) are each exposed to high temperatures due to the heat of the heating resistor and also subjected to combined influences including physical influences such as impacts of cavitations generated by expansion and contraction of the bubble and to chemical influences of ink. To protect the electrothermal transducer against these influences, the heat application portion is covered with a top protective layer. Conventionally, a protective layer of Ta, which has a relatively strong resistance against impacts of cavitations and chemical actions of ink, has been formed to a thickness of 0.2-0.5 μm to prolong the life of the head and enhance its reliability.

FIG. 26 is a schematic cross-sectional view showing a heat application portion and its surrounding portion of the conventional ink jet head. In FIG. 26, denoted 601 is a silicon substrate, 602 is a heat accumulating layer formed of a thermally oxidized film, SiO film or SiN film, 604 is a heating resistor layer, and 605 is an electrode wiring layer 605 for wires formed of such metal materials as Al, Al—Si and Al—Cu. A heating portion 604' as the electrothermal transducer is formed by removing a part of the electrode wiring layer 605 to expose the corresponding part of the heating resistor layer 604. The heating resistor layer 604 is wired over the substrate 601 and connected to a drive element circuit or an external power supply terminal. With this arrangement, the heating resistor layer 604 can be supplied electricity from outside.

Designated 606 is a protective layer provided over the heating portion 604' and the electrode wiring layer 605. The protective layer 606 also serves as an insulation layer made of a SiO film or SiN film. A reference number 607 represents an upper protective layer over the protective layer 606. The upper protective layer 607 protects the electrothermal transducer against the chemical and physical influences. A part of the upper protective layer 607 situated over the heating portion 604' is the heat application portion that is in contact with and applies heat to the ink. The upper protective layer 607 is provided solely to protect the electrothermal transducer from chemical and physical impacts and is not electrically connected with external electrodes.

The ink jet head circuit board 600 of the above construction has a flow path forming member 620. The flow path forming member 620 has an ink ejection orifice 621 formed at a position corresponding to the heat application portion, and also a flow path formed therein which communicates from an ink supply port, that pierces the circuit board 600, through the heat application portion 608 to the ink ejection orifice 621.

In the heat application portion 608 of the ink jet head, colorants and additives, when heated to high temperatures, are resolved at a molecule level and turn into substances that are difficult to dissolve. These substances are adsorbed to the upper protective layer 607. This phenomenon is called a "kogation". When hard-to-dissolve organic or inorganic substances adsorb to the upper protective layer 607, heat transmission from the heat application portion 608 to the ink becomes ununiform making the bubble generation unstable.

To minimize this kogation phenomenon a conventional practice involves using an ink containing a highly heat-resistant dye or an ink thoroughly refined to reduce the quantity of impurities in the dye. This, however, gives rise to other problems, such as an increased cost of ink or a limited number of kinds of dyes that can be used.

To solve these problems, Japanese Patent Application Laid-open No. 9-29985 (1997) discloses a cleaning method which fills the head with a water solution containing an electrolyte (kogation removing liquid), different from the ink, and applies electricity to the surface layer of Ta, which acts as heat application portion, to remove kogations accumulated on the heat application portion. In this cited document it is described that the application of electricity causes an electrochemical reaction between Ta and the water solution, which results in a part of the Ta layer surface being corroded and dissolved in the water solution to remove the deposited kogations along with the delaminating Ta layer.

For a stable generation of bubble in ink, it is important that the kogations deposited on the heat application portion be removed uniformly and reliably. However, an examination of the technique described in Japanese Patent Application Laid-open No. 9-29985 (1997) by the inventors of this invention have found a problem that the deposited kogations sometimes fail to be removed sufficiently. A further examination has revealed that the heating forms an oxide film over the surface of the Ta layer used as the upper protective layer and that this oxide film hinders the electrochemical reaction for removing kogations. That is, since the electrochemical reaction is hindered over the surface of the heat application portion where kogations are deposited, the kogations cannot be removed uniformly and reliably.

In Japanese Patent Application Laid-open No. 9-29985 (1997), a dedicated kogation removing liquid is used and needs to be supplied to the head before the cleaning is executed. This operation is performed either by a recycling company or by a user. There is, however, a problem that the cleaning cannot be done at least during the printing operation performed by the user.

SUMMARY OF THE INVENTION

The present invention has been accomplished with a view to overcoming the problems described above and it is an object of this invention to make it possible to perform a reliable high-quality printing by removing kogations deposited on the heat application portion uniformly and reliably to stabilize an ink ejection characteristic.

Another object of this invention is to make it possible to perform the cleaning during a session of printing operation without requiring a special and cumbersome cleaning procedure done by a cleaning company or by a user.

To achieve the above objectives, the present invention has the following constructions.

In a first aspect, the present invention provides a circuit board for an ink jet head comprising: a heating portion formed by a gap of an electrode wiring layer and a heating resistor layer; a protective layer formed over the electrode wiring layer and the heating resistor layer; and an upper protective layer which is arranged over the protective layer and includes at least a heat application portion which can contact with an ink and is disposed over the heating portion so that the upper protective layer can serve as an electrode to be electrically connected to cause an electrochemical reaction with the ink, and is made of a material including a metal which is dissolved by the electrochemical reaction and which does not form, on heating, an oxide film which hinders the dissolution.

In a second aspect the present invention provides an ink jet head comprising: a circuit board claimed in claim 1; and a flow path forming member having ink ejection orifices each corresponding to the heat application portion, the flow path forming member being joined to the circuit board to form an ink path leading to the ink ejection orifices.

The flow path forming member having ink ejection orifices each corresponding to the heat application portion, the flow path forming member being joined to the circuit board to form an ink path leading to the ink ejection orifices; wherein the flow path forming member directly joins to the adhesive layer at a portion outside the area to form an ink path.

A third aspect of the present invention provides an ink jet head cleaning method to remove kogation deposited on the heat application portion of the ink jet head, the method comprising the step of: using the upper protective layer as one electrode to cause the electrochemical reaction and thereby dissolve the upper protective layer in the ink.

A fourth aspect of the present invention provides an ink jet printing apparatus using an ink jet head according to any of the above aspects, the printing apparatus comprising: a cleaning means for removing kogation deposited on the heat application portion by using the upper protective layer as one electrode to cause the electrochemical reaction and thereby dissolve the upper protective layer in the ink.

A fifth aspect of the present invention provides an ink jet head cleaning method for removing kogation deposited on an upper protective layer in an ink jet head, wherein the ink jet head having: an electrothermal transducer portion arranged in an ink path communicating with an ink ejection orifice, an insulating protective layer to prevent a contact between the electrothermal transducer portion and an ink in the ink path, and an upper protective layer having a heat application portion, the heat application portion covering at least a portion heated by the electrothermal transducer portion of the protective layer, wherein the upper protective layer is formed of a material containing a metal which is dissolved by an electrochemical reaction with the ink and which does not form, on heating, an oxide film which will hinder the dissolution; the cleaning method comprising a voltage application step of: using the heat application portion as one electrode; using as another electrode a portion capable of electrically connecting to the heat application portion through the ink; and reversing polarities of both of the electrodes when applying a voltage to these electrodes.

A sixth aspect of the present invention provides an ink jet head cleaning device for removing kogation deposited on an upper protective layer in an ink jet head, wherein the ink jet head having: an electrothermal transducer portion arranged in an ink path communicating with an ink ejection orifice, an insulating protective layer to prevent a contact between the electrothermal transducer portion and an ink in the ink path, and an upper protective layer having a heat application portion, the heat application portion covering at least a portion heated by the electrothermal transducer portion of the protective layer, wherein the upper protective layer is formed of a material containing a metal which is dissolved by an electrochemical reaction with the ink and which does not form, on heating, an oxide film which will hinder the dissolution; the cleaning device comprising: a voltage application means for applying a voltage between an electrode capable of electrically connecting to the upper protective layer and the upper protective layer; wherein the voltage application means has a voltage reversing means which can reverse a polarity of the upper protective portion when applying the voltage between the heat application portion and the electrode.

A seventh aspect of the present invention provides an ink jet head comprising: an electrothermal transducer portion arranged in an ink path communicating with an ink ejection orifice; an insulating protective layer to prevent a contact between the electrothermal transducer portion and an ink in the ink path; an upper protective layer having a heat application portion, the heat application portion covering at least a portion heated by the electrothermal transducer portion of the protective layer, wherein the upper protective layer is formed of a material containing a metal which is dissolved by an electrochemical reaction with the ink and which does not form on heating an oxide film which will hinder the dissolution; an electrode capable of electrically connecting to the upper protective layer application portion through the ink; and a reversing means for reversing a polarity of the heat application portion when applying the voltage between the heat application portion and the electrode.

A eighth aspect of the present invention provides an ink jet printing apparatus using an ink jet printing apparatus using an ink jet head for printing, wherein the ink jet head having: an electrothermal transducer portion arranged in an ink path communicating with an ink ejection nozzle, an insulating protective layer to prevent a contact between the electrothermal transducer portion and an ink in the ink path, and an upper protective layer having a heat application portion, the heat application portion covering at least a portion heated by the electrothermal transducer portion of the protective layer, wherein the upper protective layer is formed of a material containing a metal which is dissolved by an electrochemical reaction with the ink and which does not form, on heating an oxide film which will hinder the dissolution; the ink jet printing apparatus comprising: a cleaning means for removing kogation deposited on the upper protective layer by using the heat application portion as one electrode and, as another electrode, a portion capable of electrically connecting to the upper protection layer portion through the ink and by reversing polarities of both of the electrodes when applying a voltage.

A ninth aspect of the present invention provides an ink jet head cleaning method for removing kogation deposited on an upper protective layer in an ink jet head, wherein the ink jet head having: an electrothermal transducer portion arranged in an ink path communicating with an ink ejection orifice, an insulating protective layer to prevent a contact between the electrothermal transducer portion and an ink in the ink path, and an upper protective layer having a heat application portion, the heat application portion covering at least a portion heated by the electrothermal transducer portion of the protective layer, wherein the upper protective layer is formed of a material containing a metal which is dissolved by an electrochemical reaction with the ink and which does not form, on heating, an oxide film which will hinder the dissolution; the cleaning method comprising the step of: using the upper protective layer as one electrode to cause the electrochemical reaction and thereby dissolve the upper protective layer in the ink, wherein a voltage application to the upper protective layer to cause the electrochemical reaction is performed in connection with an ink discharging operation that discharges the ink from the ink ejection orifice.

In the first through fourth aspect, the upper protective layer is formed of a material containing a metal that is dissolved by an electrochemical reaction and which does not form such an oxide film on heating as will hinder the dissolution. With this arrangement, a reliable electrochemical reaction can be produced to dissolve the surface layer of the upper protective layer, allowing for a uniform, reliable removal of kogation on the heat application portion. This in turn stabilizes an ejection characteristic of the ink jet head, assuring a reliable, high-quality image printing.

If an ink exists in the ink jet head, the electrochemical reaction can be initiated by using, for the upper protective layer, a material that is dissolved by the electrochemical reaction even in a liquid with not so high a pH value. This allows the ink jet head to be cleaned during one session of a printing operation.

In the fifth through eighth aspect, as in the first through fourth aspect, the kogation on the upper protective layer can be removed by dissolving the surface layer of the upper protective layer by the electrochemical reaction. Further, when a voltage is applied between the upper protective layer and the electrode, the electrode polarity of the upper protective layer can be reversed. Thus, if an ink component adheres to the upper protective layer during the process of the electrochemical reaction, it can be dispersed in the ink. Therefore, the electrochemical reaction can be produced in a more appropriate way, assuring a more reliable removal of kogations. It is therefore possible to stabilize the ejection characteristic of the ink jet head, enhance reliability and form a high-quality printed image.

In the ninth aspect, as in the first through fourth aspect, the kogation on the upper protective layer can be removed by dissolving the surface layer of the upper protective layer by the electrochemical reaction. Further, since the voltage application to the upper protective layer to cause the electrochemical reaction is performed in connection with the ink discharging recovery operation, bubbles formed on the upper protective layer can be discharged along with the ink. This in turn enables the electrochemical reaction to be conducted more appropriately, removing kogation more reliably.

Further features of the present invention will become apparent from the following description of exemplary embodiments (with reference to the attached drawings).

DESCRIPTION OF THE EMBODIMENTS

Now, the present invention will be described in detail by referring to the accompanying drawings.

1. Selection of Materials

In removing deposited kogations uniformly and reliably by corroding a surface layer of the heat application portion through an electrochemical reaction, it is strongly desired that the upper protective layer be applied uniformly with an electric potential. However, the inventors of this invention have found that if the material for the upper protective layer is not chosen appropriately, an oxide film is formed over the surface of the upper protective layer when subjected to high temperatures due to heating that is used to generate a bubble in ink, hindering a desired electrochemical reaction when a voltage is applied. To avoid this problem, it is therefore found necessary to select for the upper protective layer a material which can dissolve by an electrochemical reaction in ink and which is chemically stable even at high temperatures and does not form a strong oxide film on heating.

It is a precondition that the upper protective layer has a property of dissolving in a liquid by an electrochemical reaction in addition to its inherent function of protecting against physical and chemical impacts. Whether a particular metal has a characteristic of dissolving in a liquid through an electrochemical reaction can generally be determined by checking its voltage-pH diagram. The inventors of this invention have found that it is preferable to select a single metal of Ir or Ru, or an alloy which contains Ir and another metal or an alloy which contains Ru and another metal. Especially, since the electrothermal reaction at the upper protective layer proceeds more efficiently as ratio of content of Ir or Ru increases. Thus, preferably, the upper protective layer is preferably made of each of the single metals. However, even if the Ir alloy or the Ru alloy is used, an effect of the present invention is obtained. That is, the effect of the present invention will be obtained as long as a metal containing an Ir or Ru is used. The Applicants of the present invention obtained a finding the aspect that the material contained a metal which is dissolved by electrical reaction should be selected.

Figure 1:
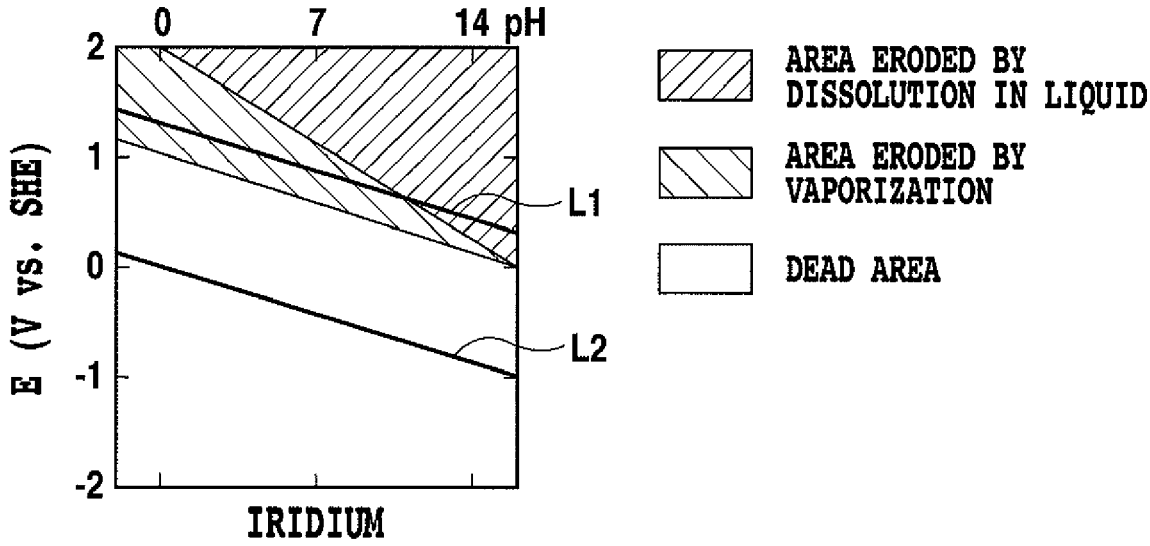
FIG. 1 is a voltage-pH diagram of Ir used as a material of an upper protective layer in embodiments of this invention.

FIG. 1 shows a voltage-pH diagram of Ir. From FIG. 1, it can be clearly seen that Ir has a region in which it dissolves when applied with a voltage as an anode electrode (a region in which Ir is corroded and dissolves in a solution; hereinafter referred to as a dissolution region). In FIG. 1, line L1, L2 represent potentials for generation and decomposition of water. That is, oxygen is produced only in a region above line L1, and hydrogen is produced only in a region below line L2. So, a stable region of water is between these lines L1 and L2.

It is assumed that the heat from the heating portion formed by a gap between electrode wires and by the heating resistor layer heats the surface of the heat application portion of the upper protective layer directly above the heating portion to about 300-600° C. Ir is known not to form an oxide film up to 800° C. even in open air and thus is preferably selected as the upper protective layer.

Ta described in Japanese Patent Application Laid-open No. 9-29985 (1997), on the other hand, forms a strong oxide film when heated and has an extremely small dissolution region. So, to cause corrosion or dissolution requires using a solution with a high pH value. Because of this requirement, the dedicated kogation removing liquid is considered to have been used in the cited document.

On the contrary, Ir has a desirable dissolution region as shown in FIG. 1, so there is no need to use a dedicated kogation removing liquid with a high pH value. The ink used in the ink jet printing contains an electrolyte and, when Ir is used, no additional liquid is necessary. That is, an electrochemical reaction can be produced even when there is an ink in the ink jet head. Therefore, it is possible for the user to execute the cleaning operation during a series of printing operation.

2. First Embodiment 2.1 Construction of Ink Jet Head

Figure 2:
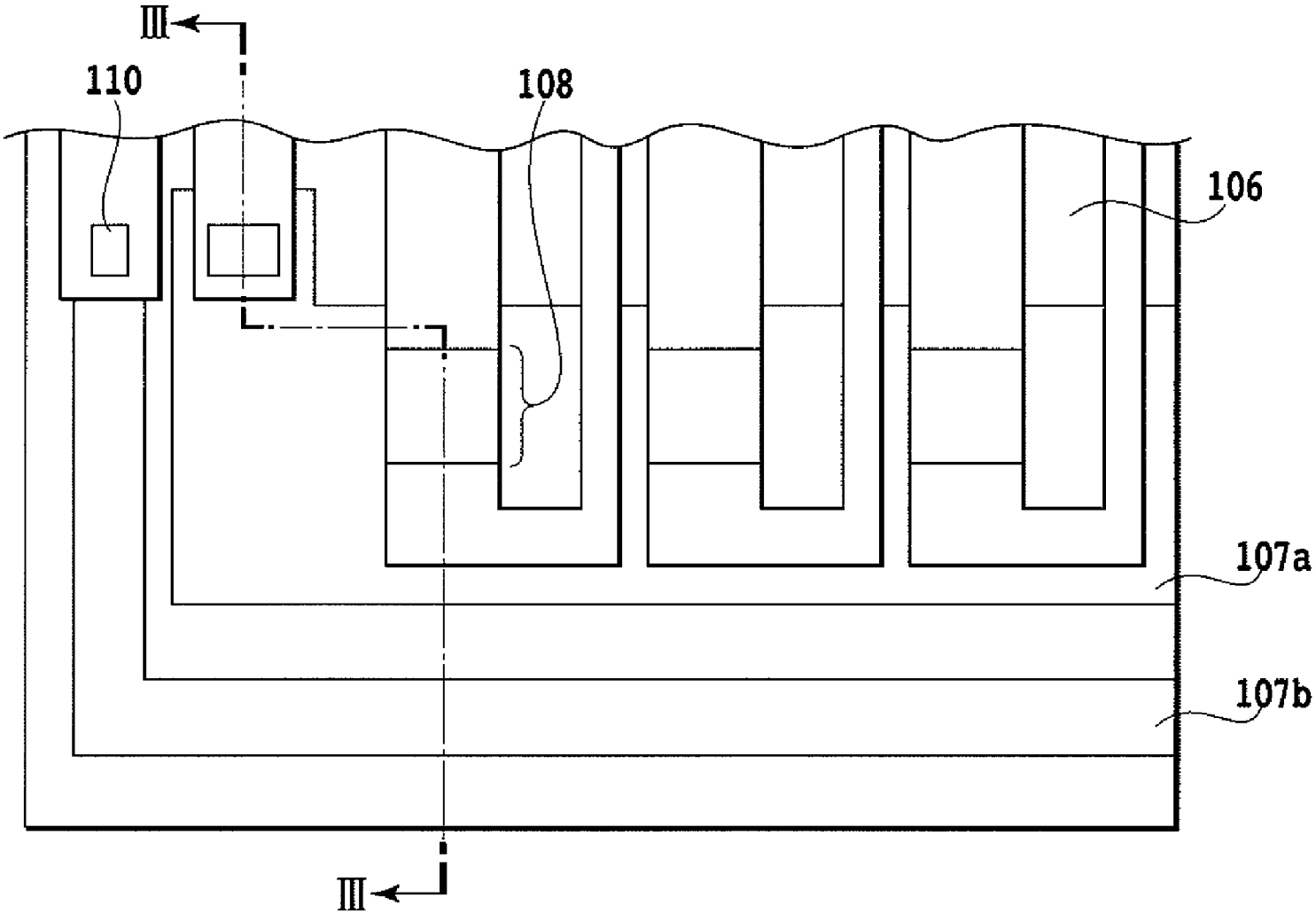
FIG. 2 is a schematic plan view showing a heat application portion and its surrounding area of an ink jet head circuit board according to a first embodiment of this invention.
Figure 3:
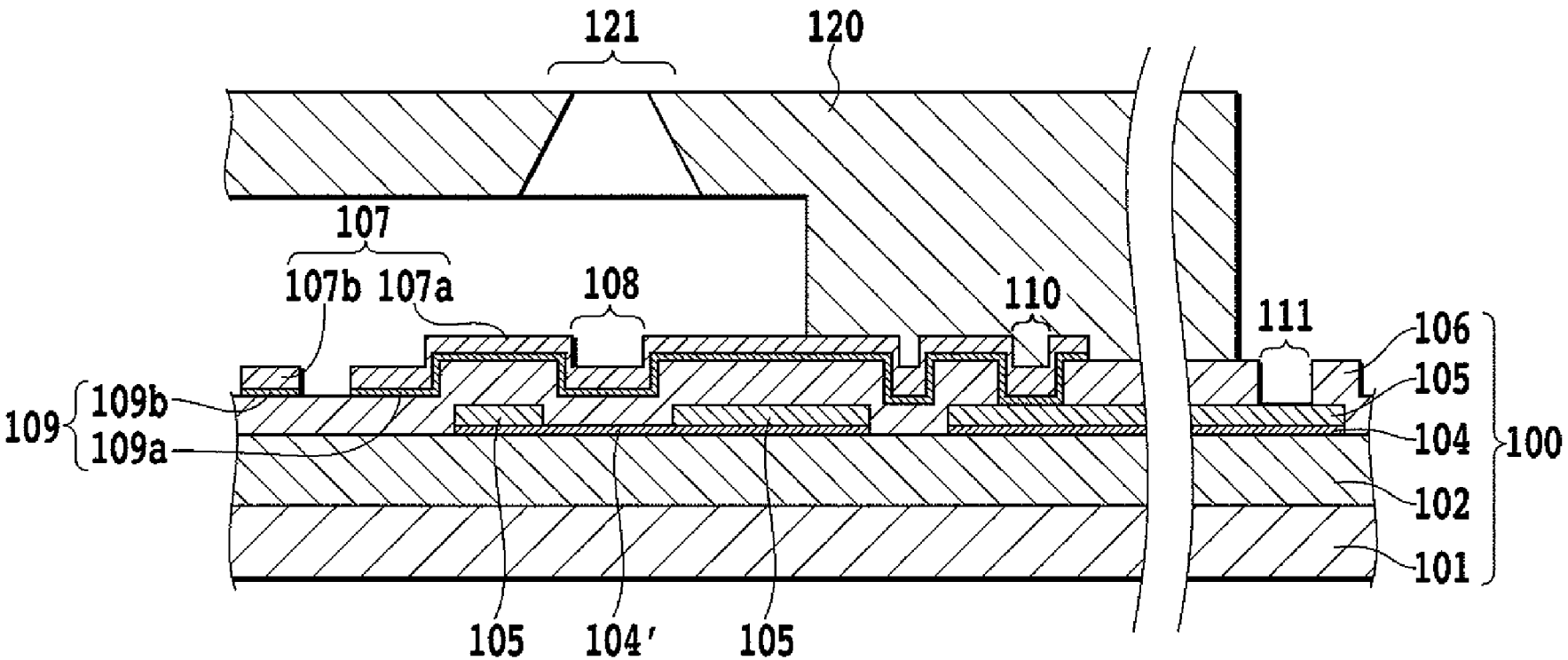
FIG. 3 is a schematic cross-sectional view of the circuit board vertically cut along the line III-III of FIG. 2.

FIG. 2 is a schematic plan view showing a heat application portion of the ink jet head circuit board (hereinafter simply referred to also as the circuit board) according to the first embodiment of this invention. FIG. 3 is a schematic cross-sectional view of the circuit board vertically cut along the line III-III of FIG. 2.

In FIG. 2 and FIG. 3, denoted 101 is a silicon substrate. Denoted 102 is a heat accumulating layer formed of a thermally oxidized film, SiO film or SiN film, 104 is a heating resistor layer, and 105 is an electrode wiring layer for wires formed of such metal materials as Al, Al—Si and Al—Cu. A heating portion 104' as the electrothermal transducer is formed by removing a part of the electrode wiring layer 105 to form a gap and then exposing the heating resistor layer in that part. The electrode wiring layer 105 is connected to a drive element circuit or external power supply terminal (not shown) to receive electricity. In the example shown, the electrode wiring layer 105 is arranged over the heating resistor layer 104. It is also possible to form the electrode wiring layer 105 over the substrate 101 or heat accumulating layer 102, remove a part of the wiring layer 105 to form a gap and then form the heating resistor layer over the wiring layer.

Denoted 106 is a protective layer 106 formed over the heating portion 104' and the electrode wiring layer 105 and which functions also as an insulating layer formed of SiO film or SiN film. Designated 107 is an upper protective layer 107 which protects the electrothermal transducer against chemical and physical impacts caused by the heating of the heating portion 104' and which dissolves to remove kogations during the cleaning operation. For the upper protective layer 107 in contact with the ink, this embodiment uses a metal that is dissolved by the electrochemical reaction in the ink, more specifically Ir. A portion of the upper protective layer 107 situated above the heating portion 104' serves as a heat application portion that applies the heat generated by the heating portion 104' to the ink. Denoted 109 is a adhesive layer 109 disposed between the protective layer 106 and the upper protective layer 107 to improve an adhesion performance with which the upper protective layer 107 adheres to the protective layer 106. The adhesive layer 109 is formed of a conductive material.

The upper protective layer 107 is inserted into a through-hole 110 and electrically connected to the electrode wiring layer 105 through the adhesive layer 109. The electrode wiring layer 105 extends to the end of the ink jet head circuit board and its front end forms an external electrode 111 for electrical connection with external circuits.

The ink jet head circuit board 100 of the above construction is bonded with a flow path forming member 120. The flow path forming member 120 has a nozzle 121 at a position corresponding to the heat application portion and also a flow path formed therein which communicates from an ink supply port, that pierces the circuit board 100, through the heat application portion to the ink ejection orifice 121.

In the above construction, since the upper protective layer 107 is formed of Ir which does not form an oxide film up to 800° C. even in open air, a voltage can be applied uniformly to the heat application portion, which, together with its dissolution by the electrochemical reaction with ink, can remove the kogations deposited on the heat application portion 108.

Ir used for the upper protective layer 107 generally has a low adhesion performance. So, the adhesive layer 109 formed between the protective layer 106 and the upper protective layer 107 improves the adhesive performance.

It is assumed in this embodiment that the electrochemical reaction between the upper protective layer 107 and the ink is utilized for removing the deposits on the heat application portion 108. For this purpose, the through-hole 110 is formed in the protective layer 106 to connect the upper protective layer 107 to the electrode wiring layer 105 through the adhesive layer 109. The electrode wiring layer 105 is connected to the external electrode 111, so the upper protective layer 107 is also electrically connected to the external electrode 111.

Further, in this embodiment, the upper protective layer 107 is divided into two areas, an area 107*a* including the heat application portion 108 formed over the heating portion 104' and the remaining area 107*b* (area on the opposing electrode side), the two areas being electrically connected. When there is no liquid on the circuit board, the area 107*a* and the area 107*b* are not electrically connected. However, when the circuit board is filled with a liquid including an electrolyte, an electric current flows through the liquid, causing an electrochemical reaction at a boundary between the upper protective layer 107 and the liquid. Although the ink used in the ink jet printing includes an electrolyte, since this embodiment uses Ir with a characteristic of FIG. 1 for the upper protective layer 107, the presence of ink can cause the electrochemical reaction or dissolution. As can be seen from FIG. 1, since the metal dissolves on the anode electrode side, a voltage should be applied in such a way that the area 107*a* is on the anode side and the area 107*b* on the cathode side in order to remove kogations on the heat application portion 108.

Further, in this embodiment, the upper protective layer area 107*b* is used as the cathode electrode in executing the electrochemical reaction. That is, the upper protective layer area 107*b* is also formed of Ir. If a desirable electrochemical reaction can be produced through a liquid (ink), other materials may be used to form the upper protective layer area 107*b*.

Further, while in the above construction the upper protective layer 107 uses Ir, other materials may be used as long as they contain a metal that is dissolved by the electrochemical reaction and which does not form an oxide film on heating that will prevent the dissolution of the metal. The material which, will not form on heating, an oxide film that hinders the dissolution of the material does not mean a material that never form an oxide film but a material which forms only such a thin oxide film, if any, as does not block the dissolution of the material. In the case of an Ir alloy or Ru alloy, the amount of an oxide film formed tends to decrease as the content of Ir or Ru increases. Therefore, the composition of the metal forming the upper protective layer 107 is selected, considering the abovementioned tendency and a durability of the metal required.

2.2 Ink Jet Head Manufacturing Process

One example process of manufacturing the ink jet head according to the first embodiment will be explained.

FIG. 4A through FIG. 4F are schematic cross-sectional views showing the process of manufacturing the ink jet head circuit board shown in FIG. 2 and FIG. 3. FIG. 5A through FIG. 5E are schematic plan views corresponding to FIG. 4A through FIG. 4E respectively.

The following manufacturing process is performed either on a silicon substrate or on a substrate into which a drive circuit constructed of semiconductor devices such as switching transistors and others for selectively driving the heating portion 104' is already built. For simplicity of explanation, however, the silicon substrate 101 is shown in the following drawings.

First, the substrate 101 is subjected to a thermal oxidation method, sputtering method or CVD method to form a heat accumulating layer 102 composed of a $SiO_2$ thermal oxidized film as an underlayer of a heating resistor layer 104. For the substrate with a built-in drive circuit, the heat accumulating layer may be formed during the process of fabricating the drive circuit.

Next, over the heat accumulating layer 102 a heating resistor layer 104 of TaSiN is formed to a thickness of about 50 nm by a reaction sputtering and then an aluminum layer as the electrode wiring layer 105 is formed to a thickness of about 300 nm by sputtering. Then, the heating resistor layer 104 and the electrode wiring layer 105 are dry-etched simultaneously using photolithography to obtain a cross-sectional structure shown in FIG. 4A and a plan view structure shown in FIG. 5A. In this embodiment, a reactive ion etching (RIE) was used as the dry etching.

Figure 4A:
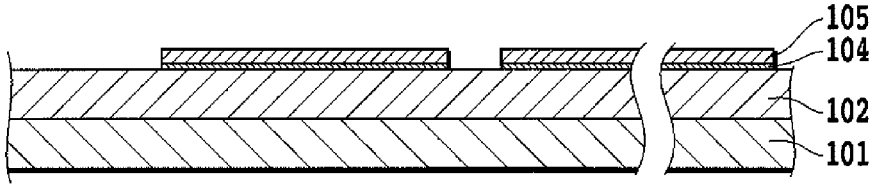
FIG. 4A to FIG. 4F are schematic cross-sectional views showing a process of manufacturing the ink jet head circuit board shown in FIG. 2 and FIG. 3.
Figure 4B:
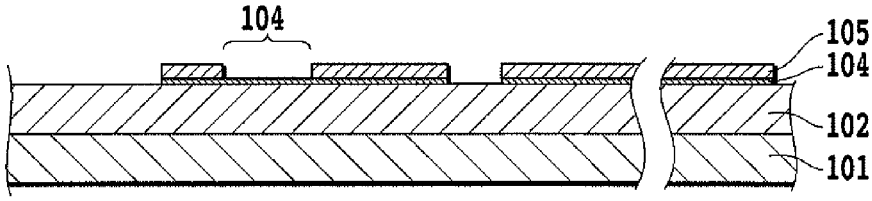
Figure 5A:
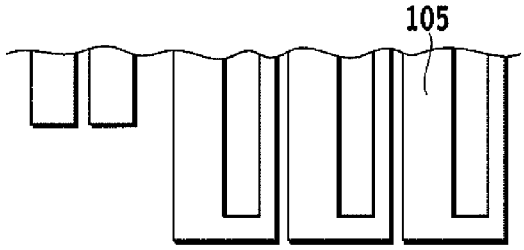
FIG. 5A to FIG. 5E are schematic plan views corresponding to FIG. 4A to FIG. 4E, respectively.
Figure 5B:
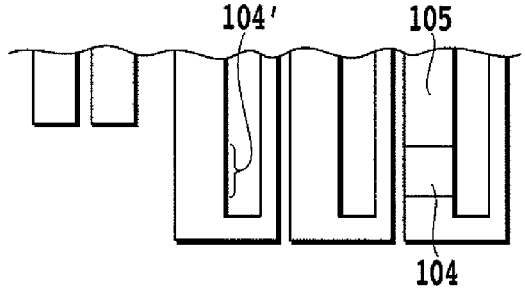

Next, as shown in FIG. 4B and FIG. 5B, the photolithography is again used to partly remove the aluminum electrode wiring layer 105 by wet etching to expose the heating resistor layer 104 at the removed portion to form the heating portion 104'. To improve the coverage of a protective layer 106 at ends of wires, it is desired that a wet etching known to be able to form an appropriate tapered configuration at wire ends be performed.

Figure 4C:
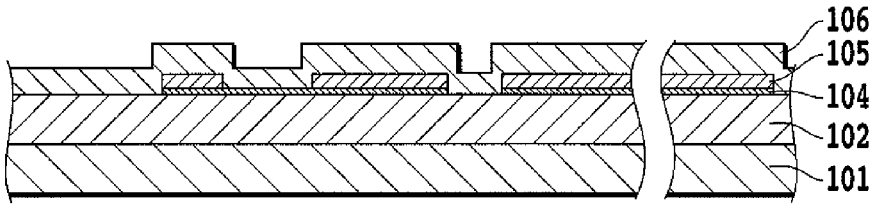
Figure 5C:
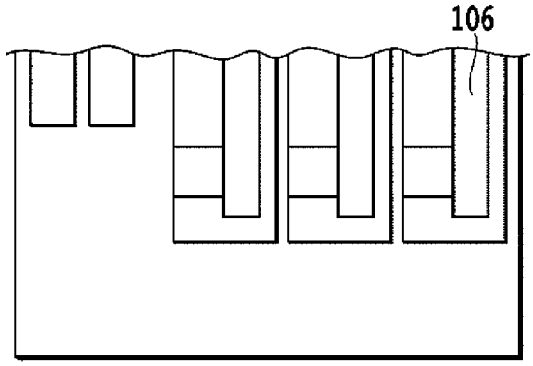

After this, as shown in FIG. 4C and FIG. 5C, the plasma CVD method is used to form a SiN film as the protective layer 106 to a thickness of about 350 nm.

Figure 4D:
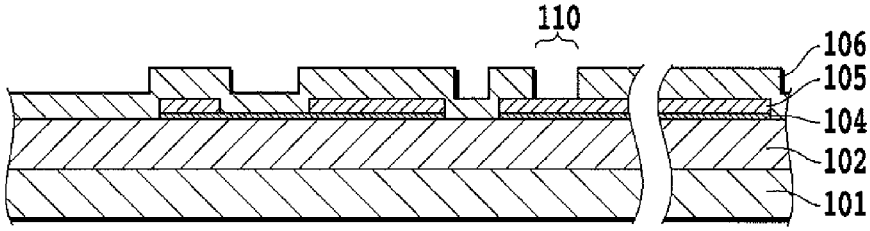
Figure 5D:
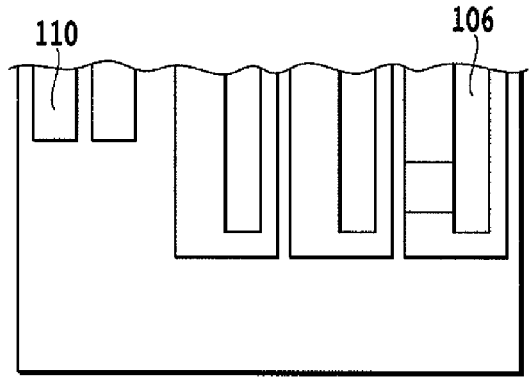

Next, the SiN film is partly removed by dry etching using photolithography, as shown in FIG. 4D and FIG. 5D, to expose the electrode wiring layer 105 at that portion, thus forming a through-hole 110 through which the upper protective layer 107 is electrically connected to the electrode wiring layer 105.

Next, a Ti layer is sputtered over the protective layer 106 to a thickness of about 50 nm to form an adhesive layer 109 that improves the adhesion performance with which the upper protective layer 107 adheres to the protective layer 106. Next, over the adhesive layer 109 an Ir layer as the upper protective layer 107 is sputtered to a thickness of about 200 nm. This state is not shown.

Figure 4E:
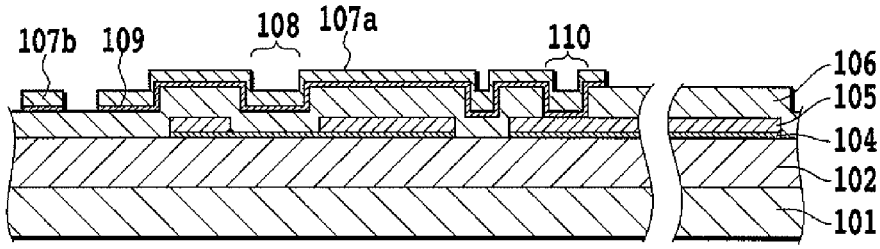
Figure 5E:
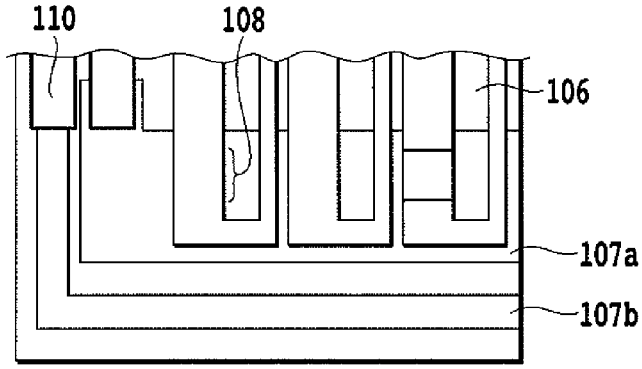

Next, the upper protective layer 107 and the adhesive layer 109 are partly removed by dry-etching using photolithography to form a pattern of the upper protective layer 107 and the adhesive layer 109, as shown in FIG. 4E and FIG. 5E. As a result, an upper protective layer area 107*a* and another upper protective layer area 107*b* are formed.

Figure 4F:
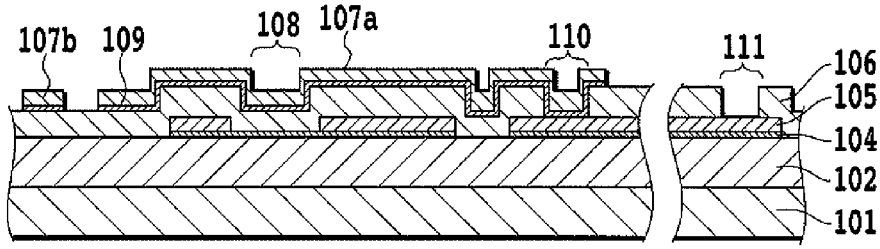

Next, the protective layer 106 is partly removed by dry etching using photolithography to partly expose the electrode wiring layer 105 at the portion, as shown in FIG. 4F, thus forming an external electrode 111.

In the above manufacturing process the dry etching is used to pattern the adhesive layer 109 and the upper protective layer 107 as a patterning method. Since Ir used in the upper protective layer 107 has a slow etch rate, the process takes time. So, the patterning of the adhesive layer 109 and the upper protective layer 107 may use a lift-off method. In that case, before forming the adhesive layer 109 and the upper protective layer 107, a delamination member is deposited and is patterned by photolithography. At this time, the delamination member is formed where the adhesive layer 109 and the upper protective layer 107 are to be removed. Then, the adhesive layer 109 and the upper protective layer 107 are formed and the delamination member is removed by a solution. As a result, a pattern of adhesive layer 109 and the upper protective layer 107 is formed. The delamination member may use inorganic materials and organic materials such as resist.

FIGS. 6A to 6D are schematic cross-sectional views showing a process of manufacturing an ink jet head using the circuit board 100 described above.

Figure 6A:
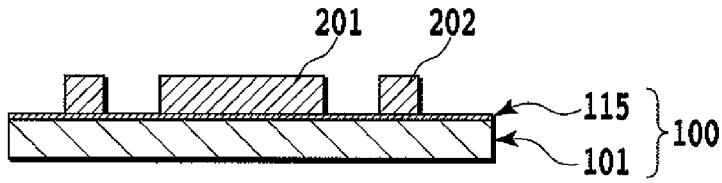
FIG. 6A to FIG. 6D are schematic cross-sectional views showing a process of manufacturing an ink jet head using a circuit board of the first embodiment.

The ink jet head circuit board 100 having a circuitry 115 of the layers described above formed on the substrate 101 is spin-coated with a resist to form dissolvable solid layers 201, 202 that will eventually form ink paths. The resist material is composed of, for example, polymethyl isopropenyl ketone and acts as a negative type resist. Then, as shown in FIG. 6A, a resist layer is patterned to a desired shape of ink path using photolithography.

Figure 6B:
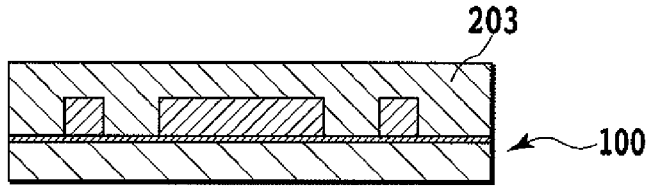

Next, as shown in FIG. 6B, a cover resin layer 203 is formed in order to form flow path walls and nozzle 121 in the flow path forming member 120 (FIG. 3). Before forming the cover resin layer 203, a silane coupling may be performed, as required, to improve the adhesion performance. The cover resin layer 203 can be formed by properly selecting a commonly known coating method and coating a resin over the ink jet head circuit board 100.

Figure 6C:
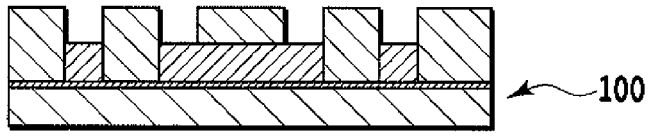

Next, as shown in FIG. 6C, the cover resin layer 203 is patterned to desired shapes of flow path walls and nozzles by using photolithography.

Figure 6D:
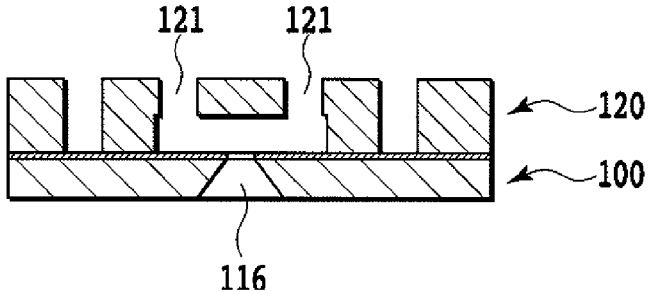

After this, as shown in FIG. 6D, an anisotropic etching, a sandblasting or an anisotropic plasma etching is performed from the back of the circuit board 100 to form an ink supply port 116. Most preferably, the ink supply port 116 may be formed by a chemical silicon anisotropic etching using tetramethyl hydroxyamine, NaOH or KOH. Then, the entire surface is exposed to a deep-ultraviolet light, developed and dried to remove the dissolvable solid layers 201, 202.

Figure 7:
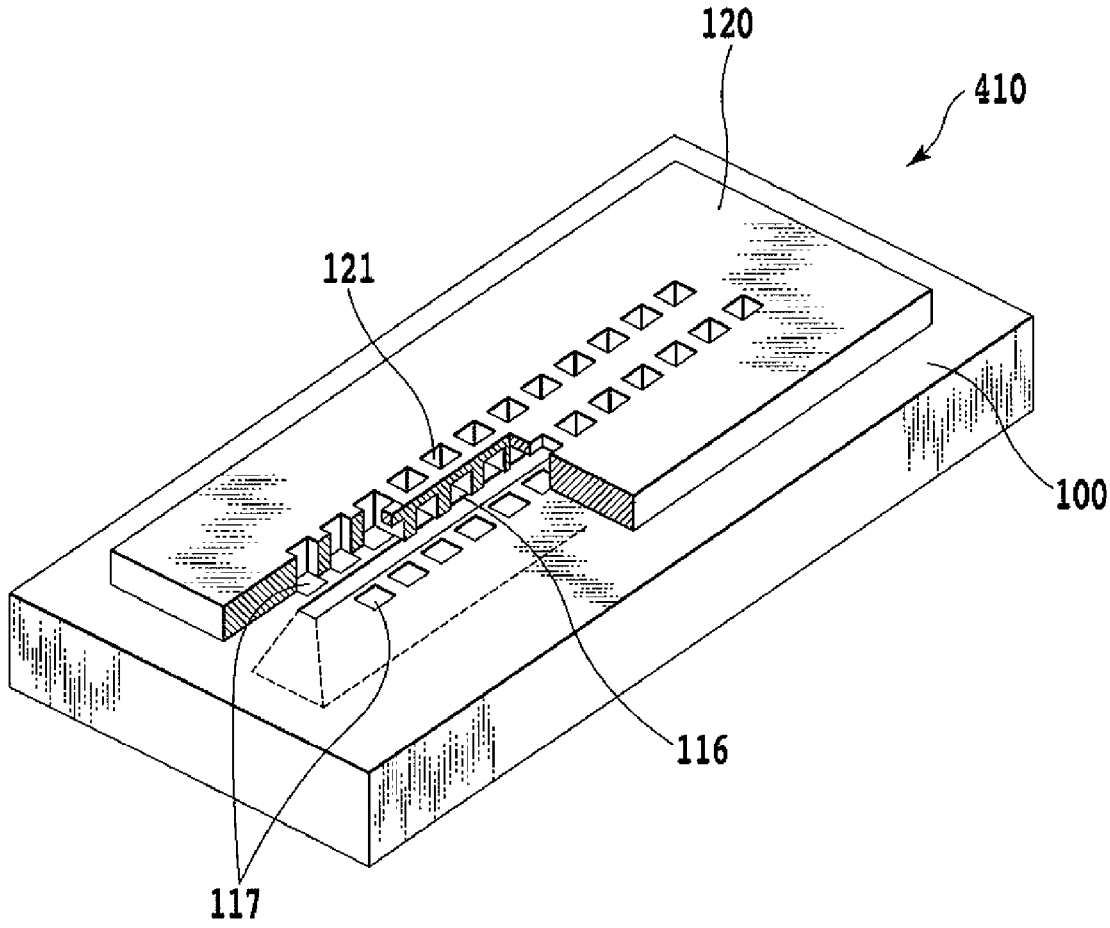
FIG. 7 is a schematic perspective view of the ink jet head manufactured by the process according to the first embodiment of this invention.

FIG. 7 is a schematic perspective view of the ink jet head manufactured by the process described above.

This ink jet head has a circuit board 100 in which two columns of electrothermal transducers 117 of a predetermined pitch (heating portion 104' and heat application portion 108) are formed side by side.

2.3 Experiment to Remove Kogations

Kogation removing experiments were conducted on two examples of the ink jet head manufactured using the circuit board with a construction of FIG. 2 and FIG. 3 and also on a comparison example in order to verify the advantages of the first embodiment.

EXAMPLE 1

Using a plurality of ink jet heads manufactured according to the process described above, kogation removing experiments were conducted. The experiments involve energizing the heating portion under a specified condition to deposit kogations on the heat application portion 108 and then applying a voltage to the upper protective layer 107 to remove the kogations. The ink used was BCI-6E M (Canon make).

First, a drive pulse with a magnitude of 20 V and a width of 1.5 μs was applied to the heating portion $5.0\times10^6$ times at a frequency of 5 kHz.

Figure 12B:
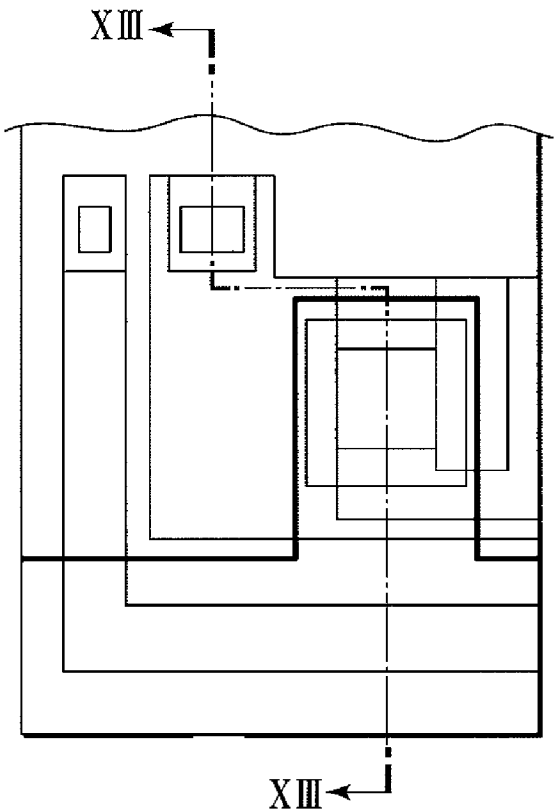
FIG. 12A to FIG. 12B are explanatory diagrams showing a lump of kogation deposited on the heat application portion of the circuit board in the second embodiment and the heat application portion cleared of the kogation.
Figure 12A:
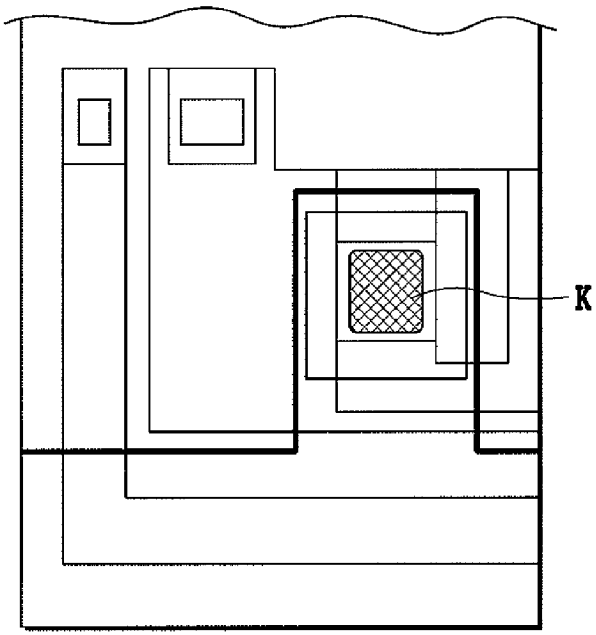

FIG. 12A schematically shows a state immediately after the application of the voltage. An impure substance K called a kogation was deposited nearly uniformly over the heat application portion 108, as shown in FIG. 12A. It was confirmed that performing a printing operation using the ink jet head in this state resulted in a poor print quality because of the deposited kogation K.

Next, a DC voltage of 10 V was applied to the external electrode 111 connected to the upper protective layer area 107*a* for 30 seconds. At this time, the upper protective layer area 107*a* was used as an anode electrode and the area 107*b* as a cathode electrode.

FIG. 12B shows a state after the voltage was applied. It was confirmed that the kogation K that had been deposited was removed from the heat application portion 108. After the voltage application, the ends of the patterns of the upper protective layer area 107*a* and the adhesive layer 109 were measured by a step height measuring device. The thickness of the upper protective layer area 107*a* was found to have decreased by about 5 nm. This shows that the electrochemical reaction with ink triggered by the voltage application to the upper protective layer 107 has dissolved Ir of the upper protective layer 107 in the ink, removing the kogation K deposited on the heat application portion 108 in the process. It was found that printing with the ink jet head in this state resulted in the print quality being recovered to almost the initial level.

Next, the ink jet head that underwent the kogation removing operation was energized again under the same condition as described above. Immediately after the second energization, the kogation K was found deposited and the print quality degraded as described above.

Then, the same kogation removing operation was conducted. It was found that the deposited kogation K was removed and the print quality recovered. Measurements of the pattern ends of the upper protective layer area 107*a* and the adhesive layer 109 indicate that the thickness of the upper protective layer decreased by approximately another 5 nm.

EXAMPLE 2

Next, in the same process as the example 1 except that the upper protective layer 107 was formed of Ru, a plurality of ink jet heads of example 2 were manufactured and subjected to the same kogation removing experiment as described above. The kogation removing experiment was conducted by energizing the ink jet head under the same condition as described above, observing the kogation deposit state and the print quality before and after the kogation removing operation, and measuring the height difference between the pattern ends of the upper protective layer area 107*a* and the adhesive layer 109.

It was verified that the kogation on the heat application portion could be removed and the print quality recovered also when Ru was used for the upper protective layer 107 as in the case of Ir.

It is known that the dry etching is easily performed with Ru compared with Ir. So, Ru allows for an easy manufacture of the ink jet head circuit board.

(Example for Comparison)

Next, in the same process as the example 1 except that the upper protective layer 107 was formed of Cr, a plurality of ink jet heads as comparison example were manufactured and subjected to the same kogation removing experiment.

Here, a drive pulse with a magnitude of 18 V and a width of 1.2 μs was applied to the electrothermal transducers $5.0\times10^6$ times at a frequency of 5 kHz. Immediately after this voltage application, deposited kogations and the print quality degradations were observed as in the above experiments.

Then, the same kogation removing operation as described above was conducted. Unlike the example 1 and example 2, the kogations remained deposited. After the voltage application, measurements were taken of the height difference between the pattern ends of the upper protective layer area 107*a* and the adhesive layer 109. The thickness of the upper protective layer area 107*a* decreased by about 7 nm. This indicates that the electrochemical reaction with ink triggered by the voltage application to the upper protective layer 107 caused Cr of the upper protective layer 107 in other areas than the heat application portion 108 to be dissolved in the ink. The reason that the kogations deposited on the heat application portion 108 could not be removed even after the dissolution of Cr is considered due to the formation of an oxide film on the heat application portion from heating. That is, the absence of the electrochemical reaction in that part of the upper protective layer 107 formed with the oxide film is considered to be the cause of the failure to remove the kogations. No recovery was observed in the print quality after this operation.

The results of these experiments are shown in Table 1.

TABLE 1

| | Upper protective layer | Ejection pulse number (cumulative) | Kogation removing condition | Print quality | Film thickness (upper protective layer + adhesive layer) |
|---|---|---|---|---|---|
| Example 1 | Ir | Initial stage | — | Good | 250 nm |
| | | $5.0\times10^6$ | — | Bad | — |
| | | — | 10 V, 30 s | Good | 245 nm |
| | | $1.0\times10^7$ | — | Bad | |
| | | — | 10 V, 30 s | Good | 240 nm |
| Example 2 | Ru | Initial stage | | Good | 250 nm |
| | | $5.0\times10^6$ | | Fair | |
| | | — | 10 V, 30 s | Good | 242 nm |
| Comparison example | Cr | Initial stage | — | Good | 250 nm |
| | | $5.0\times10^6$ | — | Bad | — |

As can be seen from the test results, to remove the kogations on the heat application portion 108 through the dissolution of a metal by the electrochemical reaction, it is necessary to select the material of the upper protective layer 107 that will not form an oxide film on heating.

It is also seen that the thickness of the upper protective layer can be determined appropriately from the film thickness reduction for each kogation removing operation and from the number of kogation removing operations contemplated to be executed on the ink jet head.

3. Second Embodiment

As described above, the dissolution of the upper protective layer 107 by the electrochemical reaction to remove the kogations from the heat application portion results in a reduction in the thickness of the upper protective layer 107. The thickness reduction covers the entire upper protective layer area 107*a* as well as the area of the heat application portion 108.

Therefore, in the construction in which the area 107*a* of the upper protective layer 107 and the flow path forming member 120 are in contact with each other, as shown in FIG. 3, the thickness reduction will create a gap at a boundary between the upper protective layer area 107*a* and the flow path forming member 120. If the number of kogation removing operations is small, a large gap may not be formed. If a small gap should be formed, it is considered not to pose any problem. However, as the number of kogation removing operations increases, the thickness reduction of the upper protective layer 107 and therefore the gap increase. This in turn degrades the adhesion performance of the upper protective layer 107 with the flow path forming member 120, which may eventually result in the upper protective layer 107 being partly delaminated. When such a delamination occurs, the nozzle communicates adjoining nozzles, giving rise to a possibility of degraded print quality.

To avoid this, it is conceivable to form the upper protective layer 107 and the adhesive layer 109 only in a limited area above the heating portion 104'. In this case, however, the protective layer 106 comes into contact with the ink, so a reliability problem of insulation may arise where the coverage performance of the protective layer 106 over stepped portions of the electrode wiring layer 105 is not satisfactory. To eliminate such undesired possibilities, the construction of a second embodiment as described below may be adopted.

3.1 Construction of Ink Jet Head

In the second embodiment of this invention, the adhesive layer 109 disposed between the protective layer 106 and the upper protective layer 107, and the upper protective layer 107 are formed in different patterns, with the adhesive layer 109 in contact with the flow path forming member 120. The adhesive layer 109 is formed mainly of a metal that does not dissolve by the electrochemical reaction in the ink. With this arrangement, the coverage performance of an area where there is no upper protective layer 107 can be maintained, without degrading the adhesion between the circuit board and the flow path forming member 120 even after the dissolution of the upper protective layer 107.

Figure 8:
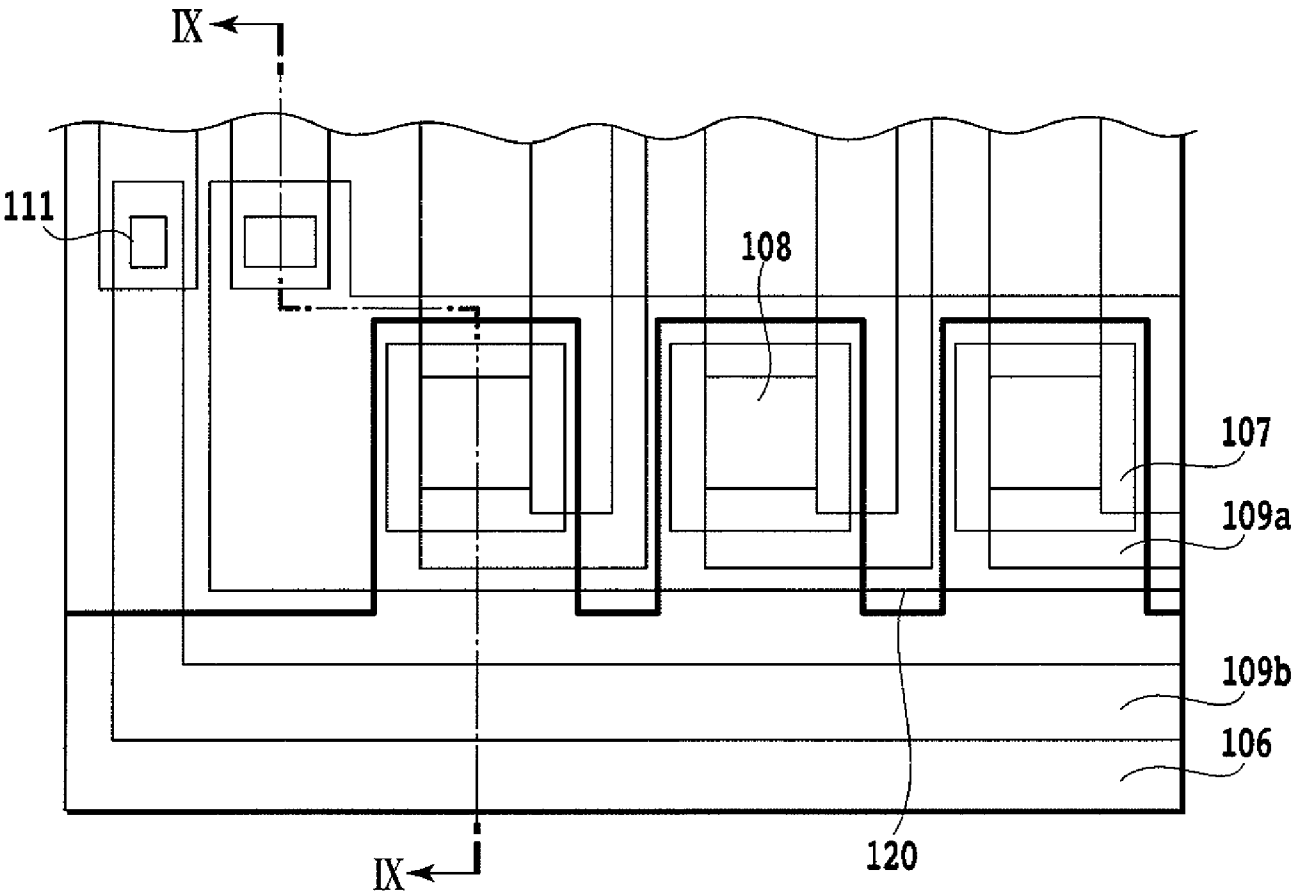
FIG. 8 is a schematic plan view showing a heat application portion and its surrounding area of an ink jet head circuit board according to a second embodiment of this invention.
Figure 9:
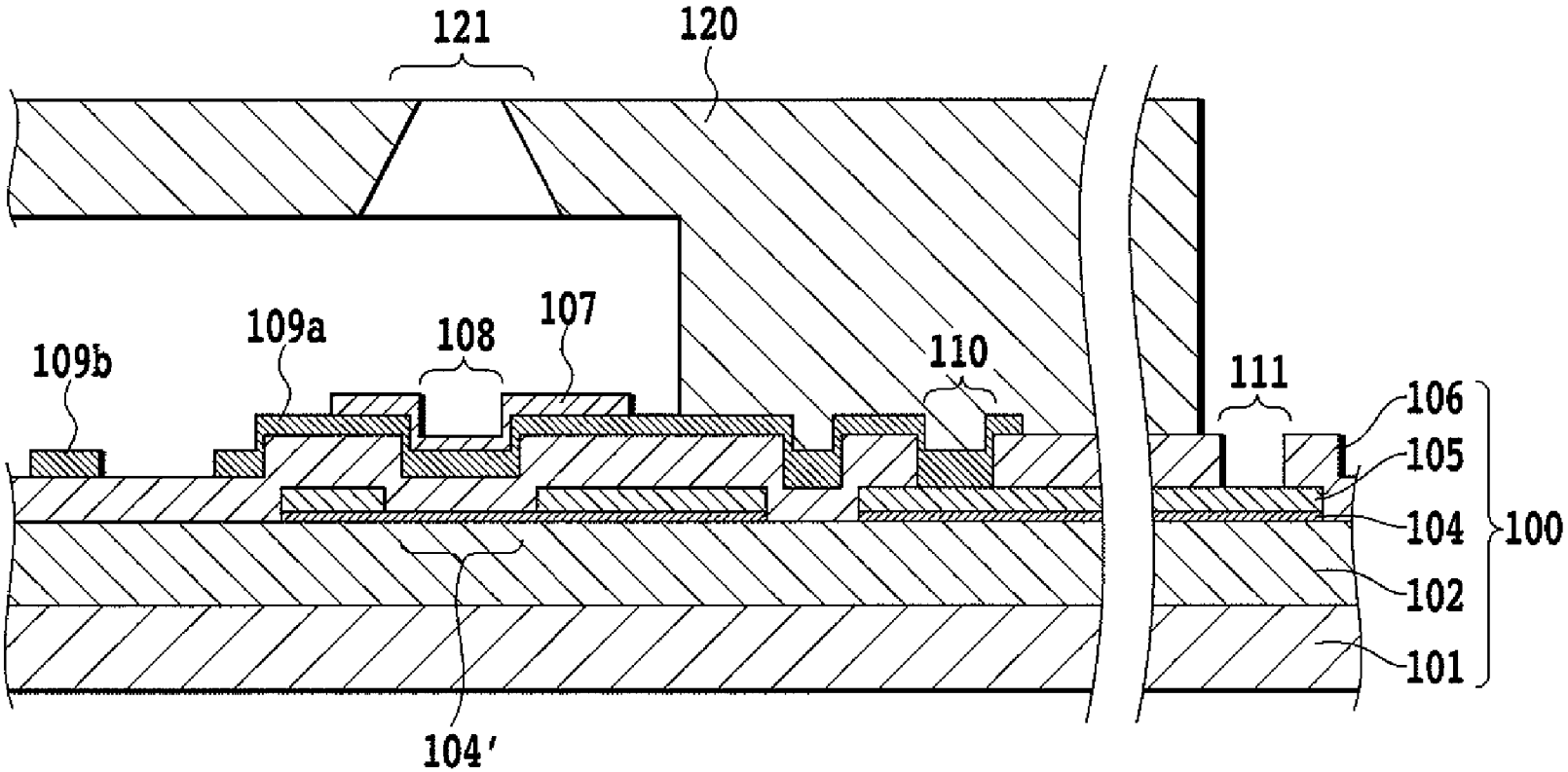
FIG. 9 is a schematic cross-sectional view of the circuit board vertically cut along the line IX-IX of FIG. 8.

FIG. 8 is a schematic plan view showing the heating portion 104' and its surrounding area of the ink jet head circuit board 100 according to the second embodiment of this invention. FIG. 9 is a schematic cross-sectional view of the circuit board 100 when vertically cut along the line IX-IX of FIG. 8. In these figures, components that can be constructed in the same way as in the first embodiment are given like reference numerals.

This embodiment differs from the first embodiment in that, while the adhesive layer 109 is formed in the same way as above, the upper protective layer 107 is formed, on the adhesive layer, in a portion which excludes the portion in which flow path forming member for forming the ink flow path is joined. The adhesive layer 109 is divided into two areas, i.e., an area 109*a* ranging from the heat application portion 108 to a portion in contact with the flow path forming member 120 and to the through-hole 110, and an area 109*b* constituting a cathode electrode opposite the area 109*a*. In this embodiment, the adhesive layer is formed of Ta.

In this embodiment, the upper protective layer 107 is connected to the external electrode 111 through the adhesive layer area 109*a* and the electrode wiring layer 105, without contacting the flow path forming member 120. The upper protective layer 107 is applied with a voltage so that it is on the anode side. Any dissolution of the upper protective layer 107 as a result of the electrochemical reaction caused by the voltage application does not raise a problem of a deteriorated adhesion between the flow path forming member 120 and the circuit board 100. This is because the adhesive layer 109 is in contact with the flow path forming member 120 and because this embodiment uses Ta for the adhesive layer 109. Ta, as described above, forms an oxide film by an anode oxidation during the electrochemical reaction in the ink and therefore practically is not dissolved.

In this embodiment, the adhesive layer area 109*b* that constitutes a cathode electrode during the electrochemical reaction is also formed of Ta. However, other materials may be used for the adhesive layer area 109*b* as long as they allow for a desired electrochemical reaction through a liquid (ink).

3.2 Process of Manufacturing Ink Jet Head

One example of an ink jet head manufacturing process according to the second embodiment will be explained.

FIGS. 10A to 10D are schematic cross-sectional views showing a process of manufacturing the ink jet head circuit board shown in FIG. 8 and FIG. 9. FIGS. 11A to 11C are schematic plan views corresponding to FIGS. 10A to 10C, respectively. This manufacturing process can be implemented following the process of FIGS. 4A to 4D and FIGS. 5A to 5D.

First, the processes similar to those shown in FIGS. 4A to 4D and FIGS. 5A to 5D are executed.

Figure 10A:
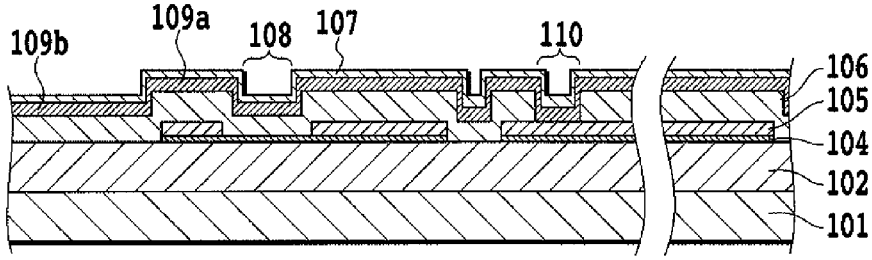
FIG. 10A to FIG. 10D are schematic cross-sectional views showing a process of manufacturing the ink jet head circuit board shown in FIG. 8 and FIG. 9.
Figure 11A:
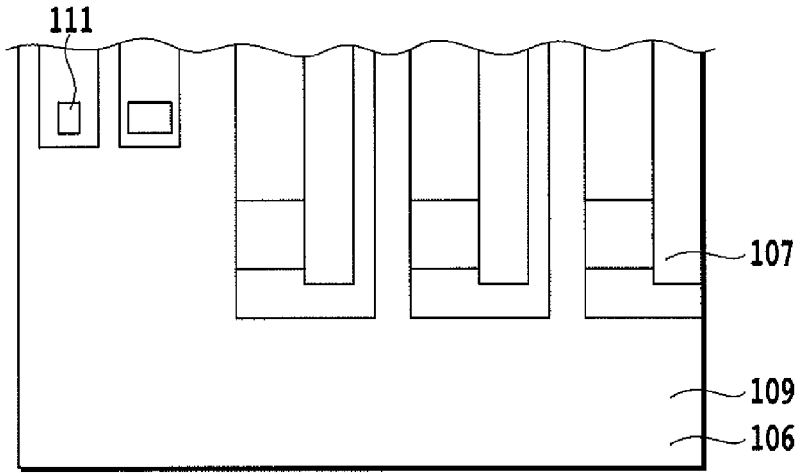
FIG. 11A to FIG. 11C are schematic plan views corresponding to FIG. 10A to FIG. 10C, respectively.
Figure 11B:
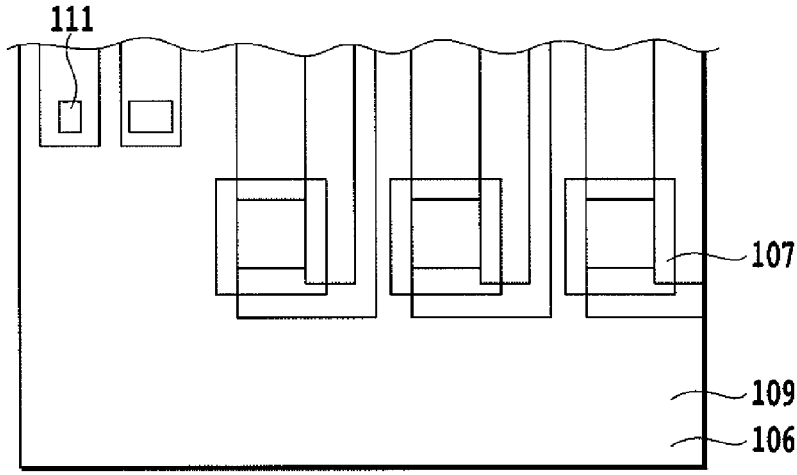
Figure 11C:
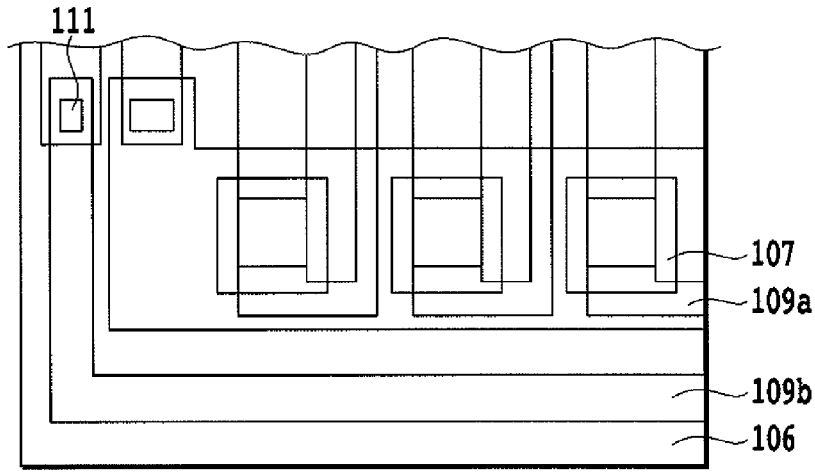

Then, as shown in FIG. 10A and FIG. 11A, Ta is sputtered to a thickness of about 100 nm to form the adhesive layer 109. Further, over the adhesive layer 109 an Ir layer as the upper protective layer 107 is formed to a thickness of about 100 nm by sputtering.

Figure 10B:
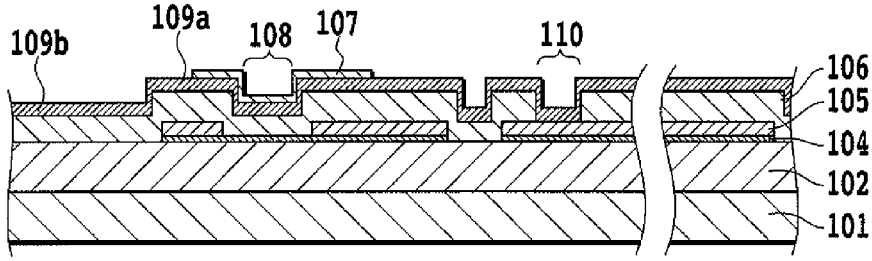

Next, to form a pattern of the upper protective layer 107 shown in FIG. 10B and FIG. 11B, the upper protective layer 107 is partly removed by dry etching using photolithography.

Figure 10C:
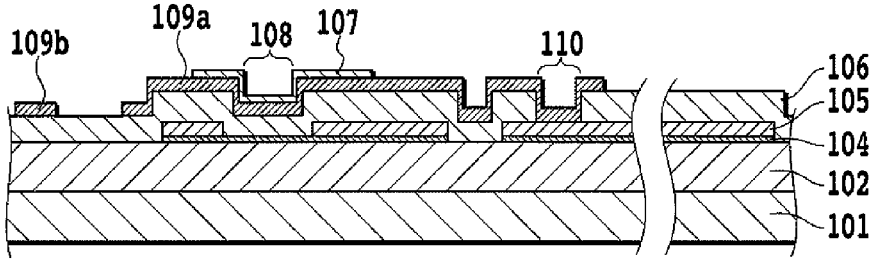

Next, to form a pattern of adhesive layer 109 shown in FIG. 10C and FIG. 11C, the adhesive layer 109 is partly removed by dry etching using photolithography. As a result, the adhesive layer area 109*a* electrically connected to the heat application portion 108 and the other adhesive layer area 109*b* are formed.

Figure 10D:
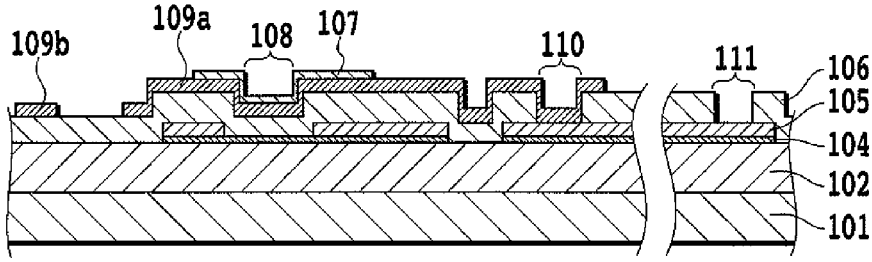

Next, to form the external electrode 111, the protective layer 106 is partly removed by dry etching using photolithography as shown in FIG. 10D to partly expose the electrode wiring layer 105 at that part.

Then, a process similar to that shown in FIG. 6A to FIG. 6D is performed and the flow path forming member 120 is arranged on the circuit board 100 to obtain the ink jet head shown in FIG. 7 to FIG. 9.

3.3 Kogation Removing Experiment

Two ink jet heads (example 3 and example 4) manufactured using the circuit board construction shown in FIG. 8 and FIG. 9 are subjected to the kogation removing tests to verify the effect of the second embodiment.

EXAMPLE 3

Using a plurality of ink jet heads manufactured in the above process, a kogation removing test was conducted. The test was done by energizing the electrothermal transducers 117 under a predetermined condition to deposit kogations on the heat application portion 108 and then applying a voltage to the upper protective layer 107. The ink used was BCI-6E M (canon make).

First, a drive pulse with a magnitude of 20 V and a width of 1.5 μs was applied to the electrothermal transducers $5.0\times10^6$ times at a frequency of 5 kHz.

FIG. 12A schematically shows a state immediately after the application of the voltage. An impurity substance K called a kogation was deposited nearly uniformly over the heat application portion 108, as shown. It was observed that performing a printing operation using the ink jet head in this state resulted in a poor print quality because of the deposited kogation K.

Next, a DC voltage of 8 V was applied to the external electrode 111 connected to the upper protective layer 107 for 15 seconds. At this time, the upper protective layer area 107*a* was used as an anode electrode and the upper protective layer area 107*b* as a cathode electrode.

FIG. 12B shows a state after the voltage was applied. It was observed that the kogation that had been deposited was removed from the heat application portion 108. It was found that printing with the ink jet head in this state resulted in the print quality recovering the almost initial level.

Figure 13:
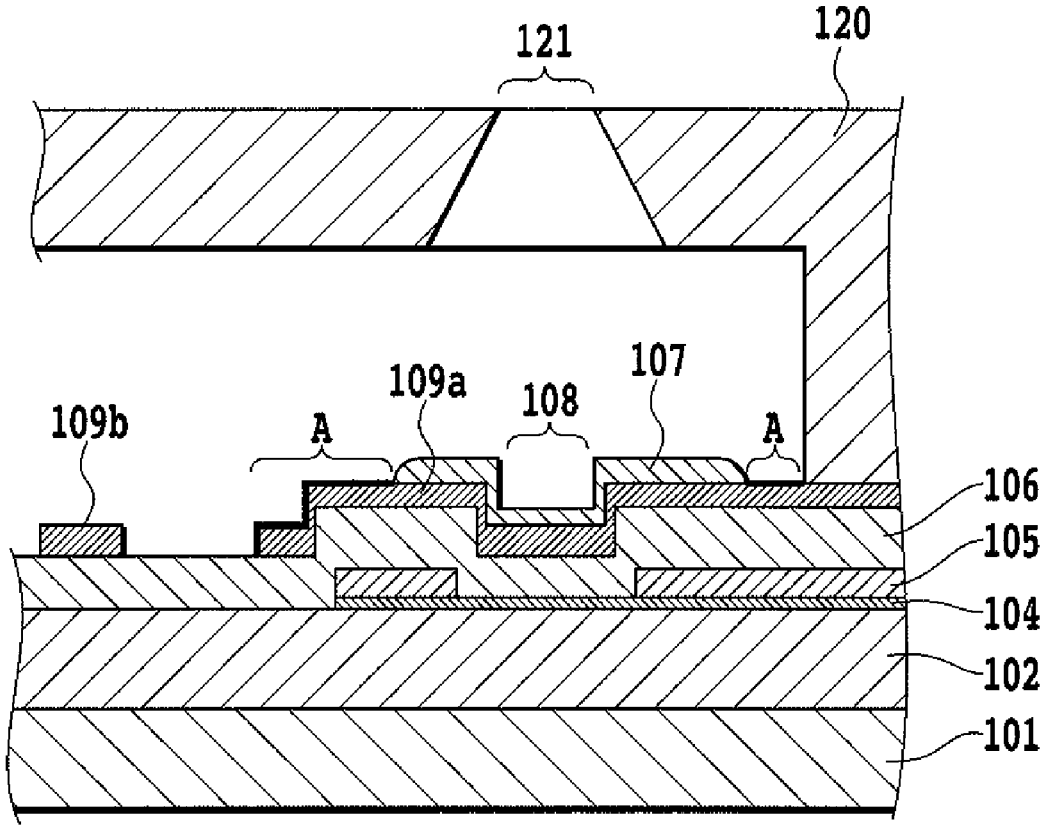
FIG. 13 is a schematic cross-sectional view of the circuit board vertically cut along the line XIII-XIII of FIG. 12B.

FIG. 13 is a schematic cross-sectional view of the circuit board vertically cut along the line XIII-XIII of FIG. 12B. The end of the pattern of the upper protective layer 107 was somewhat rounded because of its dissolution. A part of the adhesive layer area 109*a* in contact with ink (indicated by reference symbol A in FIG. 13) is formed at its surface with an oxide film by anode oxidation.

It can therefore be assumed that during the voltage application the following condition existed. First, when a voltage was applied to the adhesive layer area 109*a* and the upper protective layer 107 to remove kogations, a part of the area 109*a* which was in contact with the ink was formed at its surface with an oxide film according to the magnitude of the applied voltage. Then when the oxide film grew to a predetermined thickness, the electrochemical reaction on the surface stopped. The upper protective layer 107, on the other hand, continued to be applied a voltage through the adhesive layer 109 and its dissolution continued.

As can be seen from FIG. 13, the oxide film formed on the surface of the adhesive layer 109 prevents it from being dissolved by the electrochemical reaction and therefore a gap that will deteriorate the adhesion between the adhesive layer 109 and the flow path forming member 120 is not formed at their boundary.

Next, the ink jet head, after it had undergone the kogation removing operation, was energized again under the same driving condition as described above. Immediately after the energization, the deposition of kogation K and the print quality degradation, similar to those described above, were observed.

Then, the same kogation removing operation was performed. It was found that the deposited kogation K was eliminated and that the print quality was recovered.

EXAMPLE 4

A plurality of ink jet heads of example 4, which were manufactured in the same process as the example 3 except that the adhesive layer 109 was formed of Nb, were subjected to the kogation removing test similar to the previous example. The kogation removing test was conducted by operating the ink jet head under the same driving condition as described above and then observing the kogation deposit state and the print quality immediately after the operation of the head and after the kogation removing operation.

It was observed that the kogations on the heat application portion could be removed without deteriorating the adhesion between the flow path forming member and the circuit board also when the adhesive layer 109 was formed of Nb, as when Ta was used.

The results of the above tests are shown in Table 2 below.

TABLE 2

| | Upper protective layer | Binding layer | Number of ejection pulses (cumulative) | Kogation removing condition | Print quality |
|---|---|---|---|---|---|
| Example 3 | Ir | Ta | Initial stage | | Good |
| | | | $5.0 \times 10^6$ | | Bad |
| | | | — | 8 V, 15 s | Good |
| | | | $1.0 \times 10^7$ | — | Bad |
| | | | — | 8 V, 15 s | Good |
| Example 4 | Ir | Nb | Initial stage | — | Good |
| | | | $5.0 \times 10^6$ | — | Bad |
| | | | — | 8 V, 15 s | Good |

As can be seen from the test results, the kogations accumulated on the heat application portion during many hours of use can be removed uniformly and reliably also by the use of the ink jet head of this embodiment.

Further, the use of the ink jet head of this embodiment can remove the kogations on the heat application portion without degrading the adhesion between the flow path forming member and the circuit board. That is, even during many hours of use in which the kogation removing operation is performed many times, a high quality printing with stable and reliable ejection characteristics can be provided.

While the adhesive layer is formed of Ta or Nb, other materials may be used as long as they are not dissolved by the electrochemical reaction when removing the kogations on the heat application portion. When other materials are used, the kogations can also be removed without degrading the adhesion between the flow path forming member and the circuit board by determining a voltage at which the adhesive layer does not dissolve but at which the upper protective layer dissolves, according to the voltage-pH diagram.

4. Embodiments of Apparatus

4.1 Ink Jet Head

The ink jet head according to each of the above embodiments can be mounted on many apparatus such as printers, copying machines, facsimiles with a communication system and word processors with a printer unit, and also on industrial printing apparatus combined with various processing devices. Then, the use of this ink jet head allows for printing on a variety of kinds of print mediums, such as paper, threads, fibers, cloth, leathers, metals, plastics, glass, wood and ceramics. In this specification, the word "printing" refers to committing to a print medium not only meaningful images such as characters and figures but also meaningless images such as patterns.

Here, a cartridge type unit integrating the ink jet head and an ink tank, and an ink jet printing apparatus using this unit will be explained.

Figure 14:
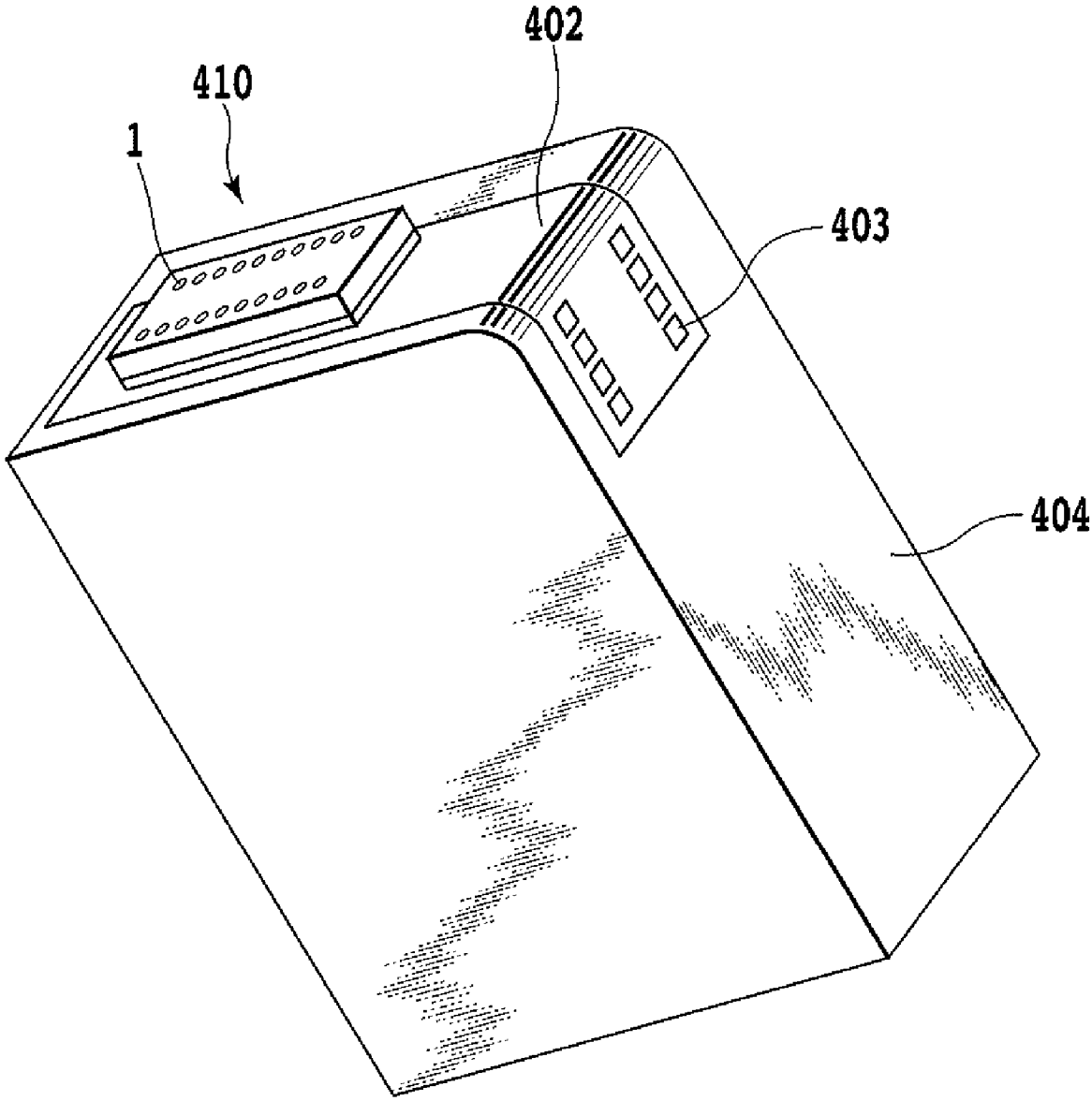
FIG. 14 is a perspective view showing an example construction of an ink jet head unit including the ink jet head of the first or second embodiment as a constitutional element.

FIG. 14 (FIG. 5) shows an example construction of an ink jet head unit 410 including the above ink jet head (reference number 1) as a constitutional element. In the figure, reference number 402 denotes a tape member for TAB (Tape Automated Bonding) having a terminal to supply electricity to the ink jet head 1. The tape member 402 supplies electric power from the printer body to the head through a contact 403. Denoted 404 is an ink tank for supplying ink to the ink jet head. That is, the ink jet head unit of FIG. 14 is of a cartridge type that can be mounted on the printing apparatus.

It is noted that the ink jet head is not limited to being applied to such an integrated construction incorporating the ink tank as described above. For example, it may be applied to a construction in which the ink tank is separably mounted and in which when the ink tank is empty of ink, it is replaced with a new ink tank. Further, the ink jet head may be formed separate from the ink tank and supplied an ink through a tube. Further, the ink jet head may be constructed not only for a serial printing system described below but also for application to a line printer in which the head has nozzles over a range corresponding to the entire width of a print medium.

4.2 Mechanical Construction of Printing Apparatus

Figure 15:
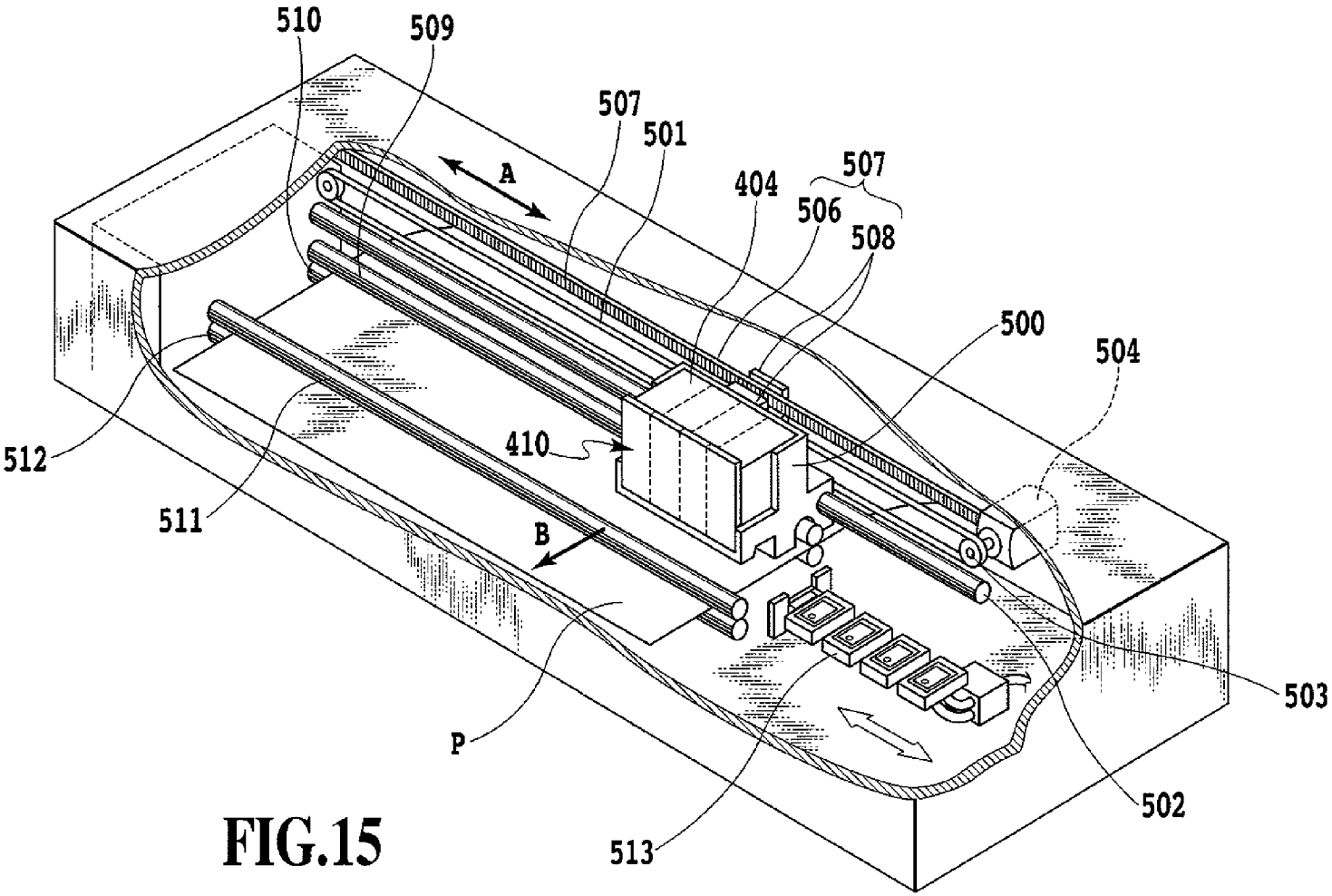
FIG. 15 is a perspective view showing an example schematic construction of an ink jet printing apparatus that uses the ink jet head unit of FIG. 14.

FIG. 15 shows an example outline construction of an ink jet printing apparatus using the ink jet head unit 410 of FIG. 14.

In the ink jet printing apparatus shown, the carriage 500 is secured to an endless belt 501 and is movable along the guide shaft 502. The endless belt 501 is wound around pulleys 503, one of which is coupled to a drive shaft of a carriage drive motor 504. Thus, the carriage 500 is reciprocally main-scanned (in a direction of A) along the guide shaft 502 as the motor 504 rotates.

The carriage 500 mounts the cartridge type ink jet head unit. The ink jet head unit is mounted on the carriage 500 in such a way that the nozzles 4 of the head 1 oppose a sheet of paper P as a print medium and that columns of the nozzles extend in a direction (e.g., a subscan direction (direction B) in which the sheet P is fed) different from the main scan direction (direction A) A pair of the ink jet head 1 and the ink tank 404 can be provided for each color of ink used. In the example case shown, four pairs are used for four colors (e.g., black, yellow, magenta and cyan).

In the apparatus shown, a linear encoder 506 is used that detects a moving position of the carriage 500 in the main scan direction. The linear encoder 506 has two constitutional elements, one of which is a linear scale 507 installed along the direction of movement of the carriage 500 and having slits formed therein at equal intervals of a predetermined density. The other constitutional element is a detection system 508 having a light emitter and a light sensor and its associated signal processing circuit. As the carriage 500 travels, the linear encoder 506 outputs an ejection timing signal defining an ink ejection timing and carriage position information.

The sheet P as a print medium is fed intermittently in the direction of arrow B perpendicular to the scan direction of the carriage 500. The sheet P is supported by a pair of roller units 509, 510 on the upstream side of the feed direction and by a pair of roller units 511, 512 on the downstream side and is given a predetermined tension as it is transported to keep its planar attitude with respect to the ink jet head 1. These roller units are driven by a transport motor not shown.

In the above construction, as the carriage 500 travels, the printing over a width corresponding to the nozzle column length of the ink jet head 1 is alternated with the feeding of the sheet P until the entire sheet P is printed.

The carriage 500 stops at a home position, as required, at the start or during the printing operation. At the home position, a cap member 513 is installed that caps a surface of each ink jet head 1 formed with the nozzles (nozzle face). The cap member 513 is connected with a mechanism (not shown) that generates a negative pressure in the cap to forcibly suck out ink from the nozzles and the ink path. This ink suction and discharge mechanism is generally called a suction-based recovery mechanism and the ink discharge operation performed by this mechanism is called a suction-based recovery operation. The suction-based recovery operation prevents a clogging of the nozzles.

4.3 Construction of Control System

Figure 16:
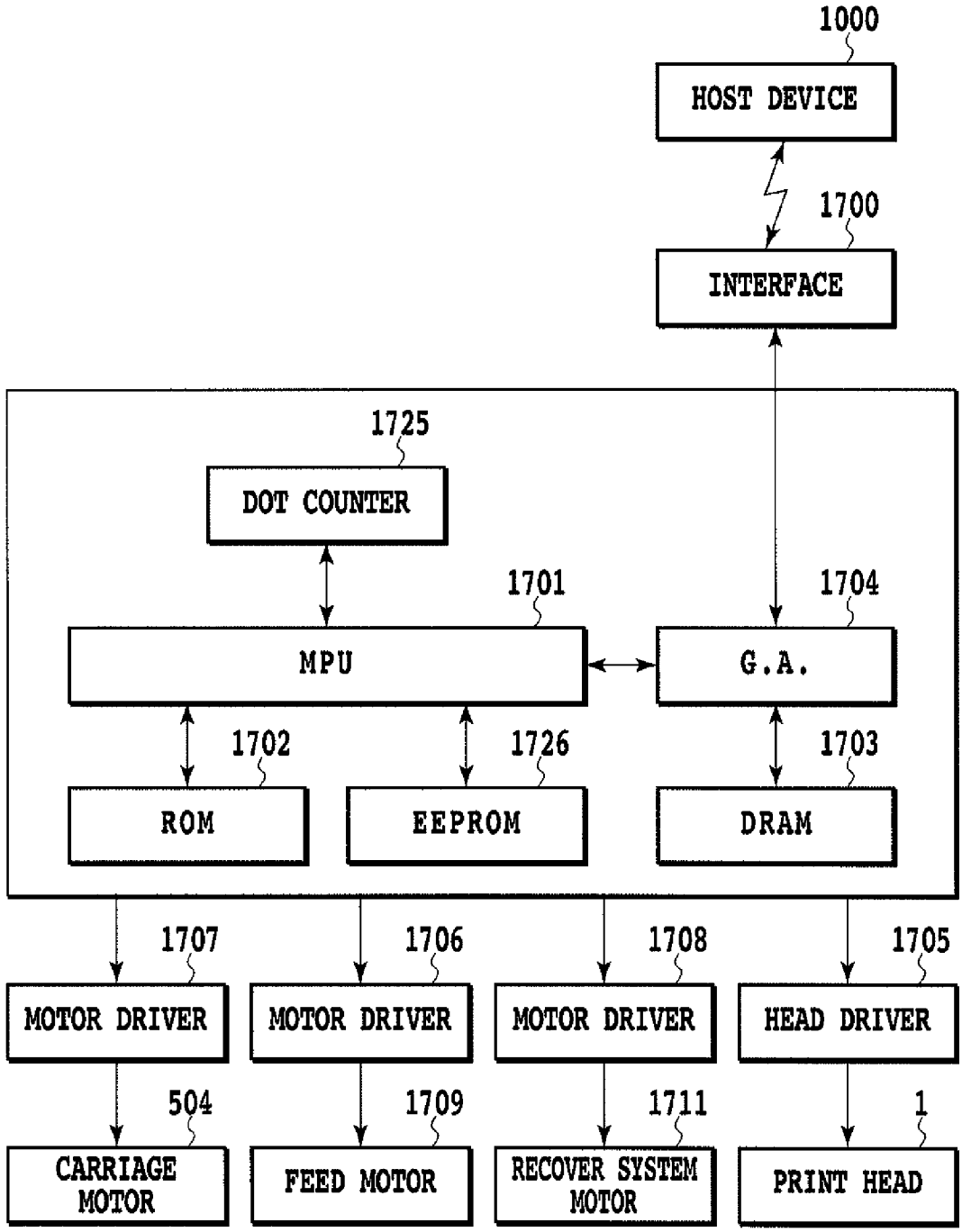
FIG. 16 is a block diagram showing an example of a configuration of a control system of the printing apparatus of FIG. 15.

FIG. 16 is a block diagram showing an example configuration of a control system of the printing apparatus described above.

In FIG. 16, denoted 1700 is an interface to receive print signals including commands and image data sent from a host device 1000 such as a computer, a digital camera and a scanner. The interface 1700, when so required, sends status information about the printing apparatus to the host device 1000. Denoted 1701 is an MPU that controls various parts in the printer according to a control program and associated data stored in a ROM 1702 defining a control procedure described with reference to FIG. 17. The data includes ink jet head driving conditions such as a drive pulse shape applied to the heating resistor layer 104 and its application duration, and a voltage applied to the upper protective layer 107 and its duration. The data may also include the condition of print medium feeding and a carriage speed.

Denoted 1703 is a DRAM to store various data (the print signal and print data to be supplied to the head). The DRAM 1703 may also have a memory area in which to store a flag used during a control procedure described later. Designated 1704 is a gate array 1704 (G.A.) to control the print data to be supplied to the head 1. The gate array 1704 also performs a data transfer control between the interface 1700, the MPU 1701 and the DRAM 1703. Denoted 1725 is a dot counter which counts ink ejections (dots) in each printing operation. Denoted 1726 is a nonvolatile memory such as EEPROM to store data when the printing apparatus is turned off.

Denoted 1709 is a feed motor used as a drive source to transport the sheet P. Denoted 1711 is a recovery system motor 1711 used as a drive source to perform a capping operation of the cap member 513 and a suction-based recovery operation using a pump. By appropriately constructing a transmission mechanism, these motors 1709 and 1711 may be shared. Denoted 1705 is a head driver to drive the head 1; and reference numbers 1706, 1707 and 1708 refer to motor drivers to drive the feed motor 1709, the carriage drive motor 504 and the recovery system motor 1711, respectively.

4.4 Control Procedure

In the ink jet head 1 according to the first and second embodiment, the upper protective layer 107 is formed of an appropriate material. Thus, even when an ink exists inside the head, an electrochemical reaction can be generated. This obviates the use of a dedicated kogation removing liquid such as described in Japanese Patent Application Laid-open No. 9-29985 (1997) and also allows the cleaning operation to be executed during a series of printing operation on the part of the user.

Figure 17:
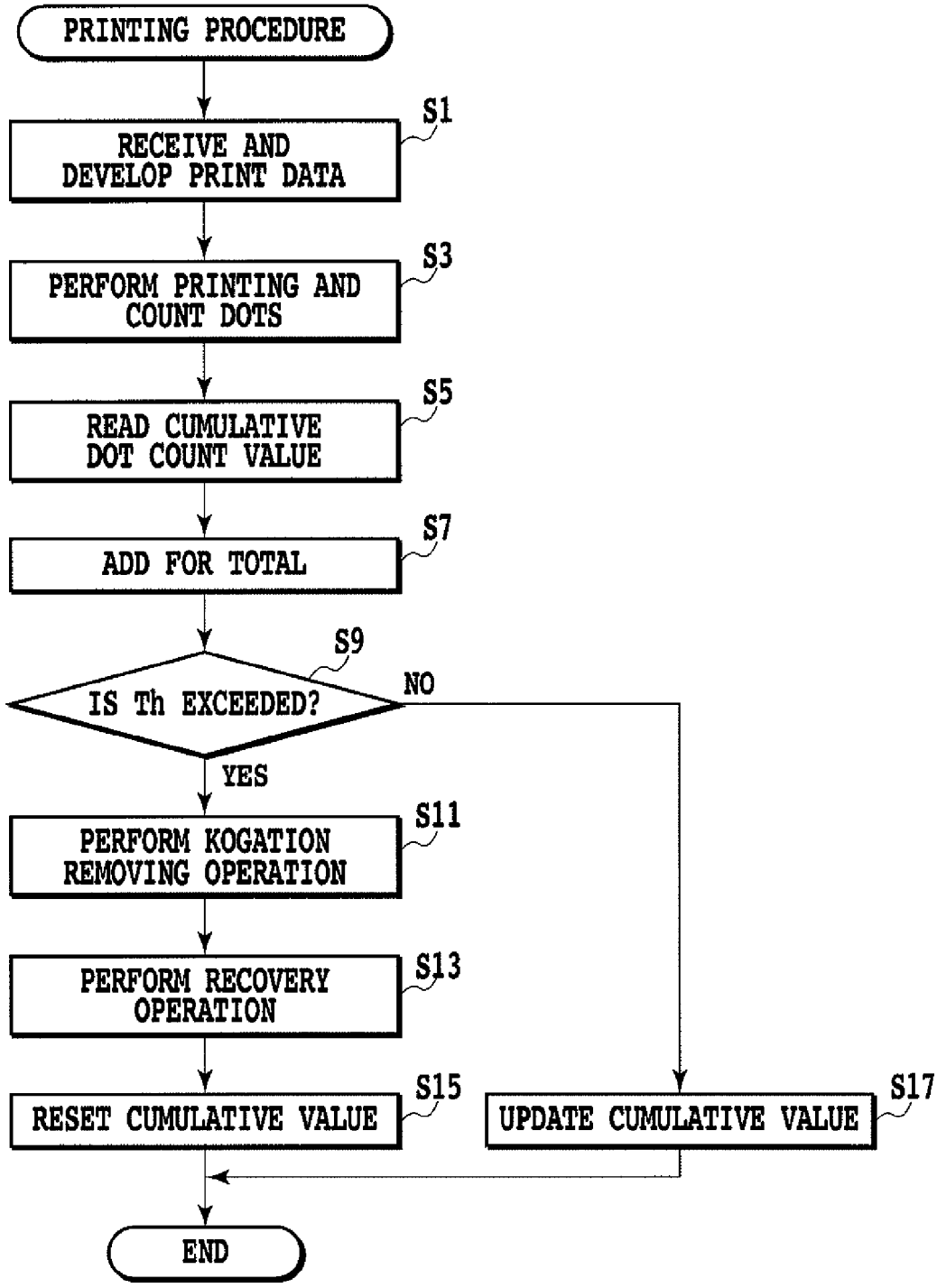
FIG. 17 is a flow chart showing an example printing procedure executed by the printing apparatus using the ink jet head of this invention.

FIG. 17 shows an example printing procedure that can be executed by a printing apparatus using the ink jet head of this invention.

When a print command is issued from the host device 1000, the following printing procedure is initiated. First, the printing apparatus receives image data to be printed from the host device 1000 and develops the image data into data compatible with the printing apparatus (step S1). Then, based on the developed print data, the feeding of the sheet P and the main scan of the ink jet head 1 are alternated to execute the printing operation (step S3). At this time, the number of printed dots (the number of drive pulses applied to the electrothermal transducers) is counted.

When one unit of printing operation (e.g., on one sheet of print medium) is finished, cumulative data of a dot count value stored in the EEPROM 1726 is read out (step S5) and the dot number just counted is added to the cumulative dot count value (step S7). Next, a check is made as to whether the resultant total value has reached a predetermined value or threshold Th (e.g., $5\times10^6$) (step S9).

If the total value is decided to have exceeded the threshold Th, a voltage is applied to the upper protective layer 107 as described earlier to remove the kogations on the heat application portion 108 along with the upper protective layer 107 (step S11). After the kogation removing operation has been executed, an ink containing the dissolved material of the upper protective layer and the removed kogations stays near the nozzle openings. If the ink does not influence the print quality, it can be used in the next printing operation and ejected from the nozzles. In this embodiment, however, a suction-based recovery operation is performed (step S13) to positively suck the ink out. Then, the cumulative data of dot count value stored in the EEPROM 1726 is reset (step S15), ending the printing procedure.

If step S9 decides that the threshold Th is not exceeded, the cumulative data of dot count value stored in the EEPROM 1726 is updated with the total value (step S17), ending the printing procedure.

While in the above procedure the kogation removing operation and the recovery operation are performed after the printing operation, they may be executed prior to the printing operation. In that case, the dot count is performed based on the print data developed in step S1 and added to the cumulative data of dot count value. The resultant total value is checked to see if the kogation removing operation should be executed. It is also possible to perform the kogation removing operation every predetermined amount of printing operation (e.g., one or several scans of the ink jet head 1).

The operation to discharge ink after the kogation removing operation is not limited to the above suction-based recovery operation. The ink discharging may be done by pressurizing the ink supply system leading to the nozzles. It can also be done by driving the heating portion to eject ink (preliminary ejection operation), the ejected ink being not intended for image forming. In this case, the drive pulses for the preliminary ejection can also be included in the count.

In either case, the present invention allows the cleaning operation including the kogation removing operation to be executed in a series of printing operation. This obviates the need for a special and cumbersome cleaning operation that requires removing the ink jet head, thus making the cleaning operation more efficient.

5. Third Embodiment 5.1 Construction of Ink Jet Head

Now, a third embodiment of this invention will be detailed by referring to the accompanying drawings.

Figure 18:
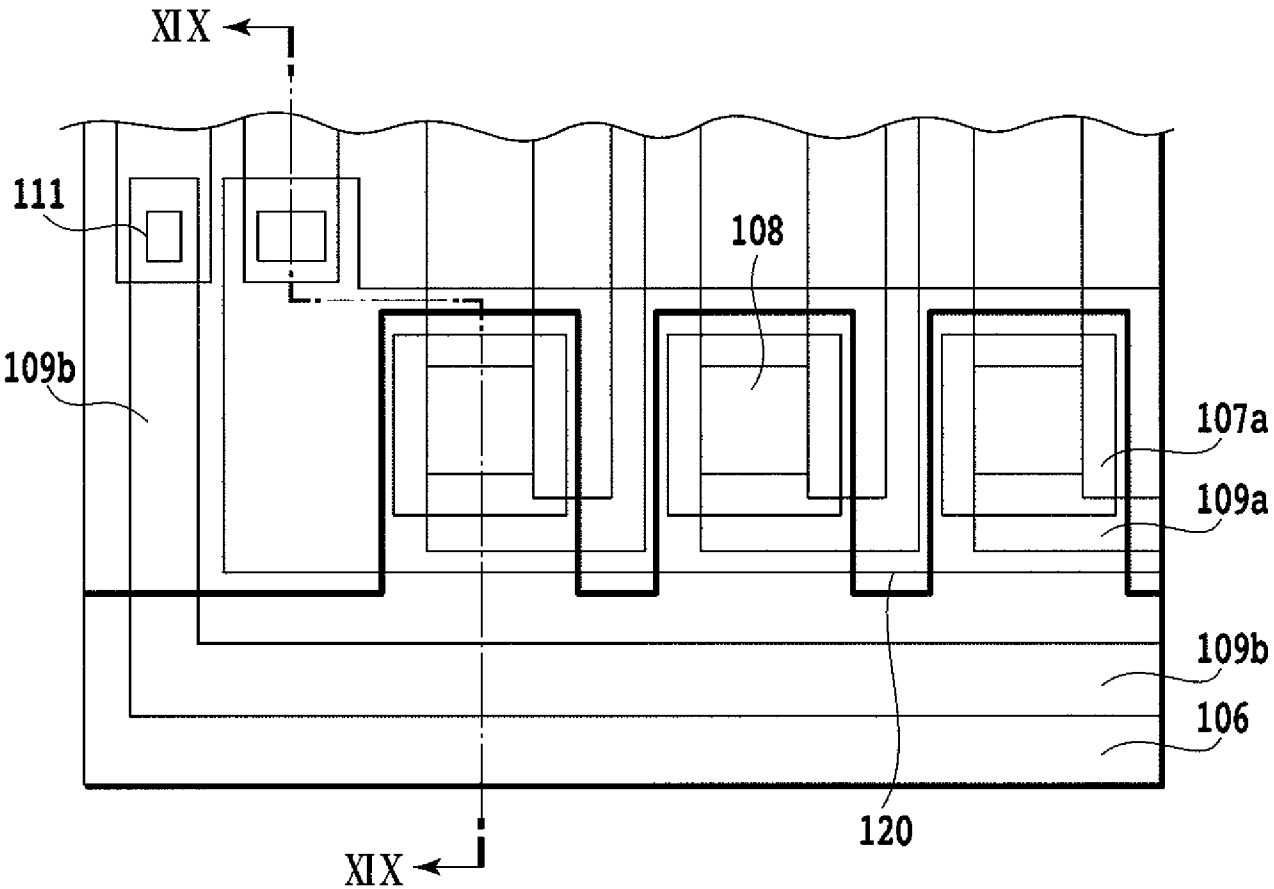
FIG. 18 is a schematic plan view showing a heat application portion and its surrounding area of an ink jet head circuit board according to a third embodiment of this invention.
Figure 19:
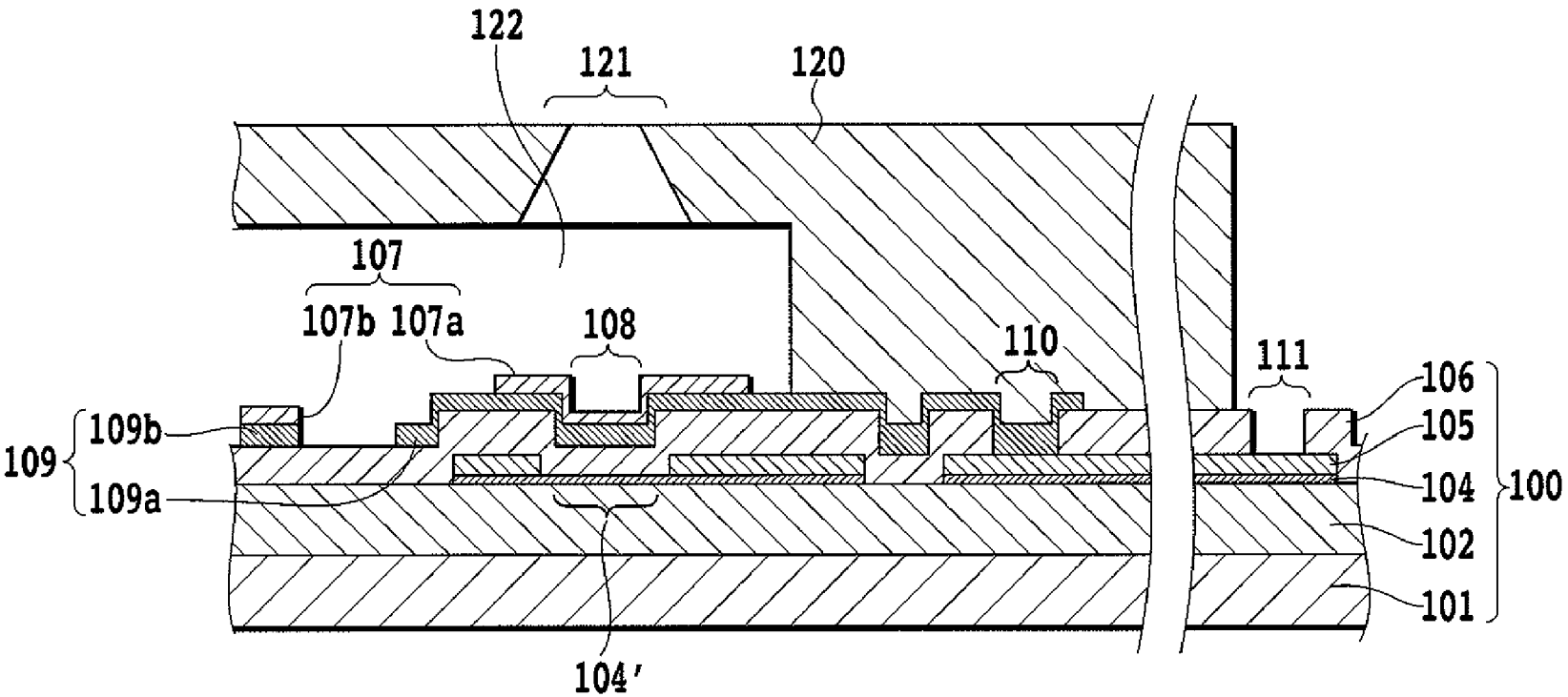
FIG. 19 is a schematic cross-sectional view of the circuit board vertically cut along the line XIX-XIX of FIG. 18.

FIG. 18 is a schematic plan view showing the heat application portion and its surrounding area of the ink jet head circuit board according to the third embodiment of this invention. FIG. 19 is a schematic cross-sectional view of the circuit board vertically cut along the line XIX-XIX of FIG. 18.

In FIG. 18 and FIG. 19, denoted 101 is a silicon substrate 101. Denoted 102 is a heat accumulating layer formed of a thermally oxidized film, SiO film or SiN film, 104 is a heating resistor layer, and 105 is an electrode wiring layer for wires formed of such metal materials as Al, Al-Si and Al-Cu. A heating portion 104' as the electrothermal transducer is formed by removing a part of the electrode wiring layer 105 to form a gap and then exposing the heating resistor layer in that part. The electrode wiring layer 105 is connected to a drive element circuit or external power supply terminal (not shown) to receive electricity. In the example shown, the electrode wiring layer 105 is arranged over the heating resistor layer 104. It is also possible to form the electrode wiring layer 105 over the substrate 101, remove a part of the wiring layer to form a gap and then form the heating resistor layer 104 over the wiring layer.

Denoted 106 is a protective layer 106 formed over the heating portion 104' and the electrode wiring layer 105. The protective layer functions also as an insulating layer formed of SiO film or SiN film. Designated 107 is an upper protective layer 107 which protects the electrothermal transducer against chemical and physical impacts caused by the heating of the heating portion 104'. The upper protective layer 107 dissolves to remove kogations during the cleaning operation. For the upper protective layer 107 in contact with the ink, this embodiment uses a metal that is dissolved by the electrochemical reaction in the ink, more specifically Ir. Ir has a property of not forming an oxide film up to 800° C. even in open air. A portion of the upper protective layer 107 situated above the heating portion 104' serves as a heat application portion that applies the heat generated by the heating portion 104' to the ink. Ir used for the upper protective layer 107 generally has a low adhesion performance with which it adheres to the protective layer 106. Therefore, an adhesive layer 109 is formed between the protective layer 106 and the upper protective layer 107 to improve the adhesion performance of the upper protective layer 107 with respect to the protective layer 106.

The adhesive layer 109 forms a wiring portion electrically connecting the upper protective layer 107 and the external terminal and is made of a conductive material. The adhesive layer 109 is inserted into the through-hole 110 formed in the protective layer 106 and is connected to the electrode wiring layer 105. The electrode wiring layer 105 extends to the ends of the substrate 101. The front end of the electrode wiring layer 105 forms an external electrode 111 for electrical connection with an external terminal. With this arrangement, the upper protective layer 107 and the external electrode 111 are electrically connected.

The ink jet head circuit board 100 is provided with a flow path forming member 120 that, together with the circuit board 100, forms an ink flow path 122. The ink flow path forming member 120 is formed with nozzles 121 at positions corresponding to the heat application portions 108. The nozzles 121 communicate with the ink path 122.

In the third embodiment, the upper protective layer 107 is divided into two areas, an area 107*a* including the heat application portion 108 and an area 107*b* that constitutes an opposing electrode when the electrochemical reaction is executed. Similarly, the adhesive layer 109 is also divided into two areas 109*a*, 109*b* which are connected to external electrodes.

Figure 20A:
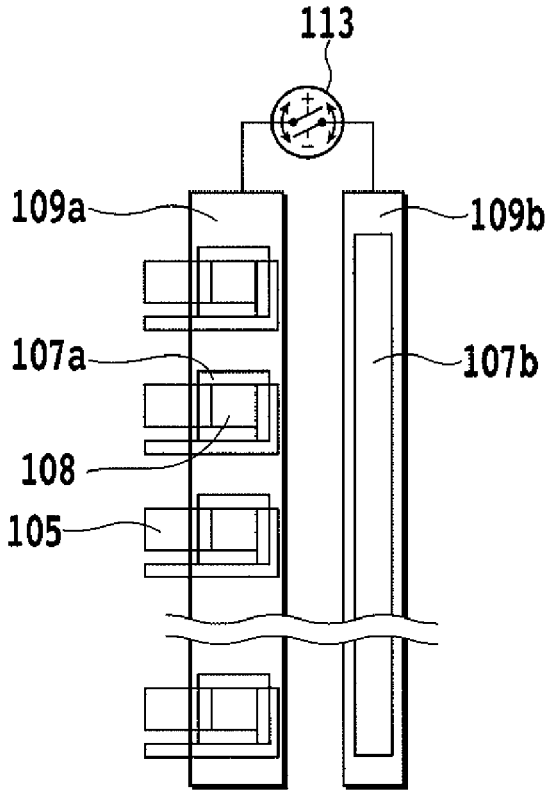
FIG. 20A schematically illustrates two areas of the upper protective layer applied with a voltage, with the area including the heat application portion taken to be an anode side electrode.
Figure 20B:
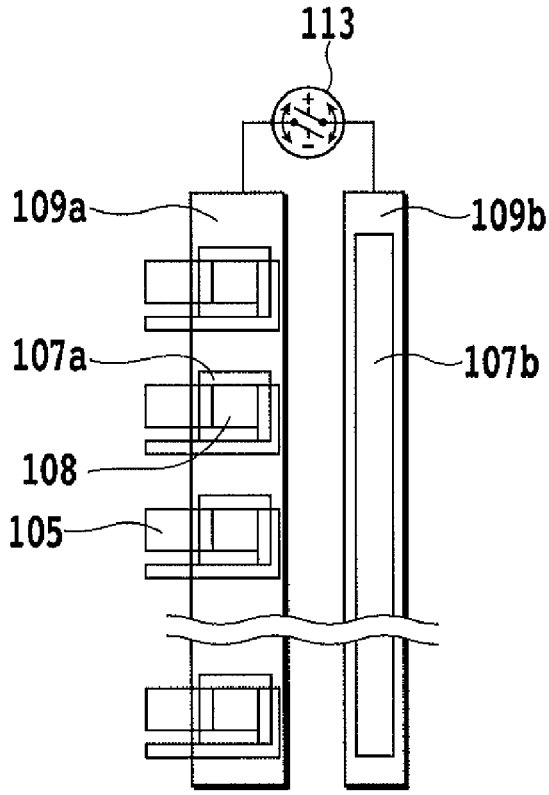
FIG. 20B schematically illustrates two areas of the upper protective layer applied with a voltage, with the area including the heat application portion taken to be a cathode side electrode.

FIG. 20A and FIG. 20B show states of voltage application in the two areas 109*a*, 109*b* of the upper protective layer on the ink jet head circuit board. Here, FIG. 20A represents a state in which a voltage is applied between the area 109*a* and the area 109*b*, with the area 109*a* including the heat application portion 108 used as an anode electrode. FIG. 20B represents a state in which a voltage is applied between the area 109*a* and the area 109*b*, with the area 109*a* used as a cathode electrode. The areas of the adhesive layer 109*a*, 109*b* are not electrically connected to each other but are connected to a voltage reversing circuit 113 composed of switching devices through the electrode wiring layer 105 that forms the external electrode. With this voltage reversing circuit 113, the areas 107*a*, 107*b* of the upper protective layer can be applied a voltage in a way that alternately reverses the anode and the cathode.

As described above, the areas 107*a* and 107*b* of the upper protective layer 107 on the ink jet head circuit board 100 are not electrically connected to each other in the construction of the circuit board. However, with a liquid containing an electrolyte filled over the circuit board, the application of a voltage between these two areas causes an electric current to flow between the two areas 107*a*, 107*b* through the electrolyte liquid, triggering an electrochemical reaction at a boundary between the upper protective layer 107 and the liquid. This is explained as follows. The ink used in the ink jet printing (in this embodiment a pigment ink) contains an electrolyte. The upper protective layer 107 is made of Ir which dissolves even in an electrolytic solution with a relatively low pH value. Therefore, if an ink exists on the circuit board, the upper protective layer can be made to initiate an electrochemical reaction or dissolve in the liquid. At this time, the dissolution of Ir occurs when Ir is on the anode side. Thus, if a voltage is applied, with the area 107*a* on the anode side and the area 107*b* on the cathode side, a dissolution occurs in the area 107*a*, removing kogations on the heat application portion 108.

However, if the polarities of voltage applied to both of the areas are kept constant, i.e., if the electrochemical reaction is proceeded by fixing the area 107*a* on the anode side and the area 107*b* on the cathode side, an ink component progressively adheres to the surface of the anode electrode and may eventually covers the entire surface of the area 107*a*. If that happens, the dissolution of the upper protective layer 107*a* is hindered, with the result that the kogations may not be able to be removed completely.

To deal with this problem, the third embodiment reverses the polarities of the applied voltage so that the areas 107*a*, 107*b* of the upper protective layer become the anode at some time and the cathode at other time, alternately. This is achieved by the voltage reversing circuit. At this time, when the area 107*a* of the upper protective layer 107 is on the anode side, the area 107*a* is dissolved, removing the kogations on the heat application portion 108. Then, when the applied voltage is reversed, the ink components adhering to or drawn to the areas 107*a*, 107*b* on the anode and the cathode side are removed or dispersed. That is, the areas 107*a*, 107*b* are not covered with a layer of ink components. When the voltage polarities are again reversed to put the area 107*a* on the anode side, Ir dissolves from the area 107*a*, further removing the residual kogations on the heat application portion 108. By repetitively performing the above operations, the kogations on the area 107*a* can be removed almost completely.

In the third embodiment, the area 107*b* of the upper protective layer is used for the electrochemical reaction. This upper protective layer area 107*b* is also made of Ir. Other materials may be used for the upper protective layer area 107*b* if they allow for a desired electrochemical reaction through a solution (ink).

Further, although the above construction uses Ir for the upper protective layer 107, other materials may be used as long as they contain a metal that is dissolved by the electrochemical reaction and which does not form, on heating, such an oxide film as will hinder the metal dissolution.

In the third embodiment, the upper protective layer 107 is out of contact with the flow path forming member 120. The upper protective layer 107 is connected to the external electrode 111 through the adhesive layer area 109*a* and the electrode wiring layer 105 so that it can be applied a voltage. The dissolution of the upper protective layer 107 due to the electrochemical reaction caused by the voltage application does not result in a deteriorated adhesion between the flow path forming member 120 and the circuit board 100. This is because the adhesive layer 109 is in contact with the flow path forming member 120 and because the adhesive layer 109 of this embodiment is formed of Ta as in the second embodiment. That is, Ta, as described above, forms an oxide film on its surface by an anode oxidation during the electrochemical reaction in the ink and therefore practically is not dissolved. As a result, the adhesion of the adhesive layer 109 to the flow path forming member 120 and to the circuit board 100 is kept from deteriorating.

In the third embodiment, the reversal of the anode electrode and the cathode electrode is done by the voltage reversing circuit 113 on the ink jet head circuit board. However, the voltage polarities may be reversed in the ink jet head printing apparatus body and applied to the upper protective layer 107 from the external electrode.

EXAMPLE 5

Next, the cleaning operation of the ink jet head in the third embodiment will be explained in detail for the following examples.

A plurality of the above ink jet heads were prepared and subjected to a kogation removing experiment using the cleaning methods of the above embodiments. The experiments involve energizing the heating portion 104' as an electrothermal transducer under a specified condition to deposit kogations on the heat application portion 108 and then applying a voltage to the upper protective layer 107 to remove the kogations. The ink used was a pigment ink of resin dispersion type.

First, a 20-V drive pulse 1.5 μsec wide was applied to the heating portion 104' $5.0\times10^6$ times at a frequency of 5 kHz.

Figure 21A:
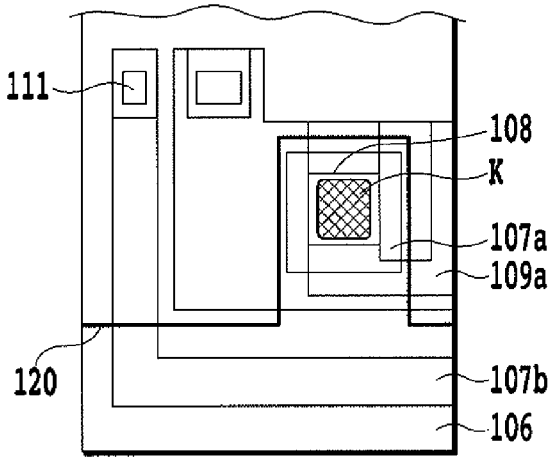
FIG. 21A schematically illustrates a state of the upper protective layer of an electrothermal transducer immediately after the electrothermal transducer has been operated.

FIG. 21A schematically shows a state of the upper protective layer 107 immediately after heating portion 104' was driven. An impurity substance (kogation) K was deposited nearly uniformly over the heat application portion 108, as shown. It was observed that the print quality of an image printed by the ink jet head in this state was worse than that of an image printed by the ink jet head with no kogation K deposited.

Next, in the kogation removing operation (cleaning operation), a DC voltage of 10 V was applied to the external electrode 111 connected to the upper protective layer area 107*a* for 15 seconds. In this case, upper protective layer 107*a* was used as an anode electrode and upper protective layer 107*b* was used as a cathode electrode.

Figure 21B:
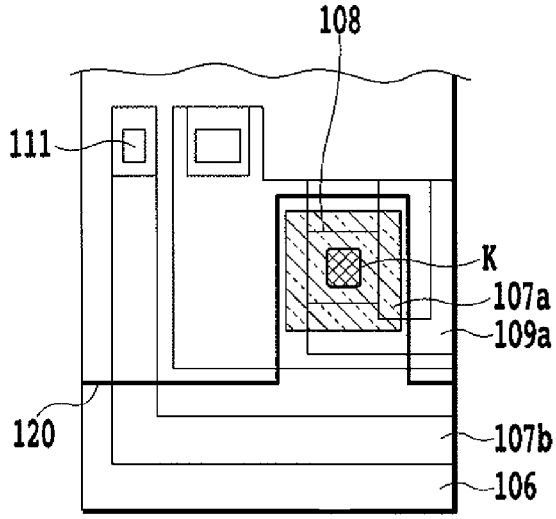
FIG. 21B to FIG. 21D schematically illustrate states of the upper protective layer of the electrothermal transducer, showing how a kogation adhering to the upper protective layer is removed by the kogation removing operation in the third embodiment of this invention.

FIG. 21B shows a state after the voltage was applied in the kogation removing operation. It was observed that the kogation K deposited on the heat application portion 108 was somewhat removed as shown. However, an ink component adhering to the surface of the upper protective layer area 107*a* indicated that the kogation K could not be removed completely.

Figure 21C:
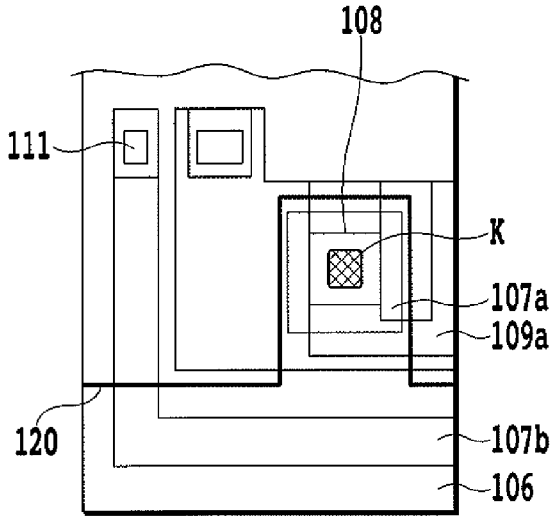
Figure 21D:
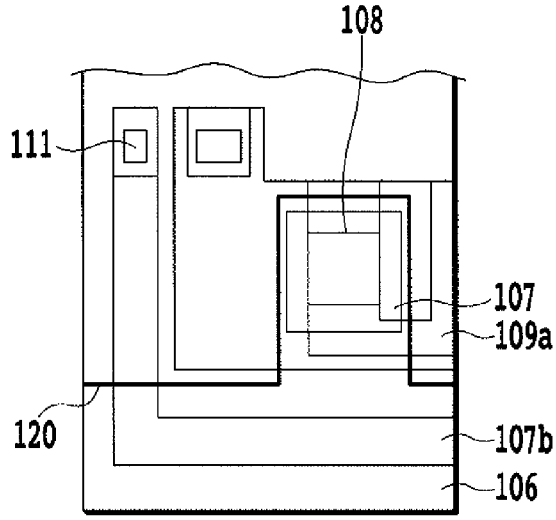

Then, a voltage was applied under the same condition as above, except that the upper protective layer area 107*a* was used as a cathode electrode and the upper protective layer area 107*b* as an anode electrode. As shown in FIG. 21C, the ink component adhering to the surface of the upper protective layer area 107*a* was removed but the deposited state of the kogation K remained unchanged. A voltage was again applied under the same condition, with the upper protective layer area 107*a* as the anode electrode, and then the voltage was also applied by putting the upper protective layer area 107*a* on the cathode side. As a result, the kogation K deposited on the heat application portion 108 was completely removed, as shown in FIG. 21D. It was observed that printing with the ink jet head in this state resulted in the print quality being recovered to almost the initial level.

From these test results it can be assumed that during the voltage application the following status change occurred in the surface of the upper protective layer area 107*a*, as shown in FIG. 21B to FIG. 21D.

First, when a voltage was applied to the adhesive layer area 109*a* and the upper protective layer 107 to remove kogations, a part of the adhesive layer area 109*a* which was in contact with the ink was formed at its surface with an oxide film. Then when the oxide film grew to a predetermined thickness, the electrochemical reaction on the surface stopped. The upper protective layer area 107*a*, on the other hand, continued to be applied a voltage through the adhesive layer 109 and its dissolution continued. However, since an ink component adhered to the area 107*a* at the same time that the area was dissolved, the reaction between the ink and the area 107*a* was restrained, stopping the dissolution. Therefore, the kogation K could not be removed completely. Then, a voltage was applied by putting the area 107*a* on the cathode side. This caused the ink component adhering to the area 107*a* to disperse in the ink again, recovering the state in which the surface of the area 107*a* came into direct contact with the ink. The above sequence of steps was repetitively executed to completely remove the kogation K.

Further, since the surface of the adhesive layer 109 was formed with an oxide film, it was not dissolved by the electrochemical reaction. Therefore, at the boundary between the adhesive layer 109 and the flow path forming member 120, no gap was formed which would deteriorate the adhesion between them.

Next, in the ink jet head that had undergone the kogation removing operation, the electrothermal transducer was energized again under the same driving condition as described above. Immediately after the energization, the deposition of kogation K similar to that described above was observed. The image printed in this state was found to have a print quality degradation.

After this, the same kogation removing operation as described above was performed. The deposited kogation K was eliminated and the initial print quality was restored.

Results of the above tests are shown in Table 3.

TABLE 3

| Ink used | Number of ejection pulses (cumulative) | Kogation removing condition | Surface state | Print quality |
|---|---|---|---|---|
| Pigment ink | Initial stage | — | Good | Good |
| | $5.0\times10^6$ | — | Good | Bad |
| | — | Anode: 10 V, 15 s | Bad | Bad |
| | — | Cathode: 10 V, 15 s | Good | Bad |
| | — | Anode: 10 V, 15 s | Bad | Bad |

TABLE 3-continued

| Ink used | Number of ejection pulses (cumulative) | Kogation removing condition | Surface state | Print quality |
|---|---|---|---|---|
| | — | Cathode: 10 V, 15 s | Good | Good |
| *For reference | Initial stage | — | Good | — |
| Dye ink | $5.0 \times 10^6$ | — | Good | Bad |
| | | Anode, 10 V, 30 s | Good | Good |

In the surface state column of Table 3, "good" represents a state in which kogation is not deposited, and "bad" represents a state in which kogation is deposited. In the print quality column, "good" represents a good print quality and "bad" a degraded print quality. The dye ink used is BCI-6e (Canon make).

The above test results show that the cleaning method of this embodiment can reliably remove kogation K even when the kogation K has deposited on the heat application portion 108 after many hours of a printing operation using a pigment ink, as when a dye ink is used.

5.3 Control Procedure

Figure 22:
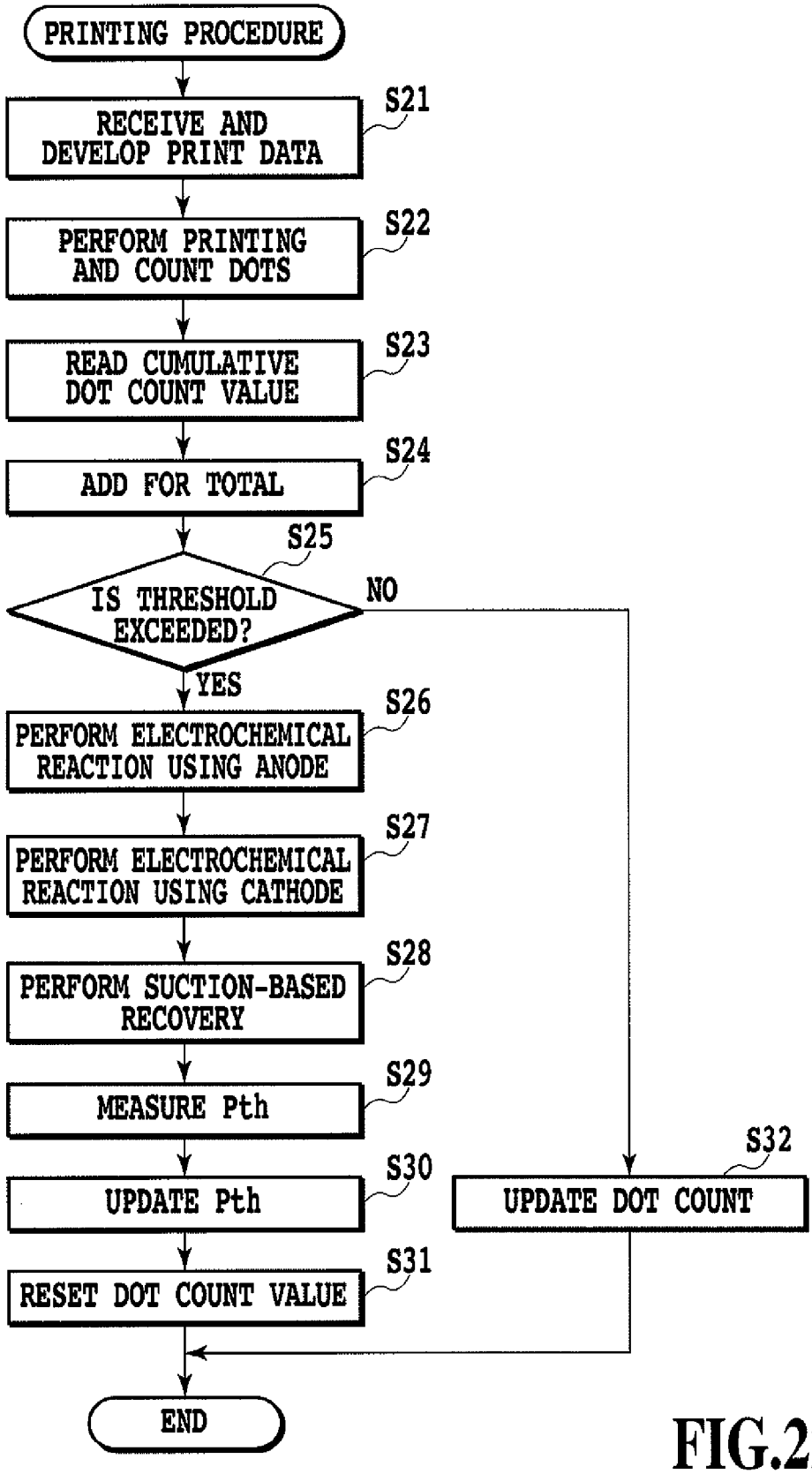
FIG. 22 is a flow chart showing an example printing procedure performed by the ink jet printing apparatus of the embodiment of this invention.

FIG. 22 is a flow chart showing an example printing procedure executed in the third embodiment of this invention. In the third embodiment, too, the ink jet printing apparatus of the construction shown in FIG. 15 and FIG. 16 is used. It is noted, however, that in the third embodiment the head driver 1705 functions as a heater drive unit that drives the heating portion 104' in each ink path according to the print data and also as a reversal control unit to control the voltage reversing operation of the voltage reversing circuit 113. The head driver 1705 and a power supply unit together form a voltage application means.

When a print command is issued from the host device 1000, the following printing procedure is initiated. First, the printing apparatus receives image data to be printed from the host device 1000 and develops the image data into data compatible with the printing apparatus (step S21). Then, based on the developed print data, the feeding of the sheet P and the main scan of the ink jet head 1 are alternated to execute the printing operation (step S22). At this time, the number of printed dots (the number of drive pulses applied to the electrothermal transducers) is counted.

When one unit of printing operation (e.g., on one sheet of print medium) is finished, cumulative data of a dot count value that was accumulated in the EEPROM 1726 before the start of this printing operation is read out (step S23) and the dot number just counted is added to the cumulative dot count value (step S24). Next, a check is made as to whether the resultant total value has exceeded a predetermined threshold (e.g., $1\times10^7$) (step S25).

If the total value is decided to have exceeded the threshold, a voltage is applied to the area 107*a* of the upper protective layer 107 by alternately switching the voltage polarity between the anode and cathode side during the electrochemical reaction as described earlier to remove the kogations on the heat application portion 108 along with the upper protective layer 107*a* (step S26, S27). After the kogation removing operation has been executed, an ink containing the dissolved material of the upper protective layer and the removed kogations stays near the nozzle openings. If the ink does not influence the print quality, it can be used in the next printing operation and ejected from the nozzles. In this embodiment, however, a suction-based recovery operation is performed (step S28) to positively discharge the ink. Since the area 107*a* of the upper protective layer 107 dissolves as the kogation removing operation proceeds, the film thickness above the heating portion 104' decreases. So, to keep a high print quality, a threshold of electrical energy required to produce a bubble, for example, threshold Pth of a pulse width or a pulse voltage is measured again and stored (step S29, S30). Then, the cumulative data of dot count value stored in the EEPROM 1726 is reset (step S11), ending the printing procedure.

If step S5 decides that the threshold is not exceeded, the cumulative data of dot count value stored in the EEPROM 1726 is updated with the total value (step S12), ending the printing procedure.

While in the above procedure the kogation removing operation and the recovery operation are performed after the printing operation, they may be executed prior to the printing operation also in the third embodiment.

The operation to discharge ink after the kogation removing operation is not limited to the above suction-based recovery operation. The ink discharging may be done by pressurizing the ink supply system leading to the nozzles. It can also be done by driving the heating portion to eject ink (preliminary ejection operation), the ejected ink being not intended for image forming.

In either case, the third embodiment obviates the need for a special and cumbersome cleaning operation that requires removing the ink jet head, thus allowing for a more efficient cleaning operation.

6. Fourth Embodiment

As in the first embodiment, dissolving the upper protective layer 107 by the electrochemical reaction to remove kogation from the heat application portion produces bubbles as the reaction proceeds. The bubbles thus generated may prevent the upper protective layer from uniformly dissolving in the ink. In recent years an ink jet head has been realized or is being proposed which has an ejected ink droplet size of as small as a few to one picoliter or less than one picoliter. If the kogation removing method of this invention is used when the ink droplet size is very small as with such an ink jet head, the bubbles generated by the electrochemical reaction may partly hinder the reaction between the upper protective layer and the ink, resulting in the kogation failing to be removed uniformly and reliably.

To deal with this problem, the fourth embodiment of this invention employs a cleaning method which performs the voltage application to the upper protective layer 107 to dissolve it by the electrochemical reaction after the ink suction operation has been started. This enables the ink to be sucked out before the bubbles generated by the electrochemical reaction grows large, thus removing the kogation uniformly and reliably.

6.1 Kogation Removing Experiment

In the process of manufacturing the circuit board shown in FIG. 8 and FIG. 9 and the ink jet head of FIG. 6, an ink jet head with an ejected ink droplet volume of 5 picoliters was fabricated. Kogation removing tests were conducted on an example 6 using this ink jet head and on a comparison example, to verify the effects of the fourth embodiment.

Embodiment 6

Using the ink jet head described above and the cleaning method of this embodiment, the kogation removing tests were conducted. The kogation removing experiment involves energizing the heating portion under a predetermined condition to deposit kogation on the heat application portion 108 and then applying a voltage to the upper protective layer 107. The ink used is BCI-6e M (Canon make).

Figure 23A:
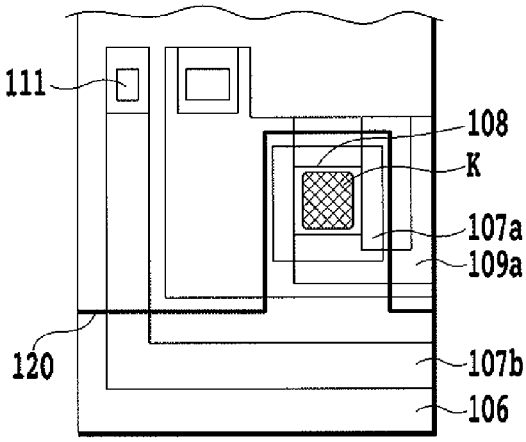
FIG. 23A schematically illustrates a state of the upper protective layer of an electrothermal transducer according to a fourth embodiment of this invention immediately after the electrothermal transducer has been operated.

First, a 20-V drive pulse 1.5 μs wide was applied to the heating portion $5.0\times10^6$ times at a frequency of 5 kHz. As shown in FIG. 23A, an impurity K called kogation was found deposited nearly uniformly on the heat application portion 108. Performing a printing operation using the ink jet head in this state resulted in a degraded print quality because of the deposited kogation K.

Figure 24:
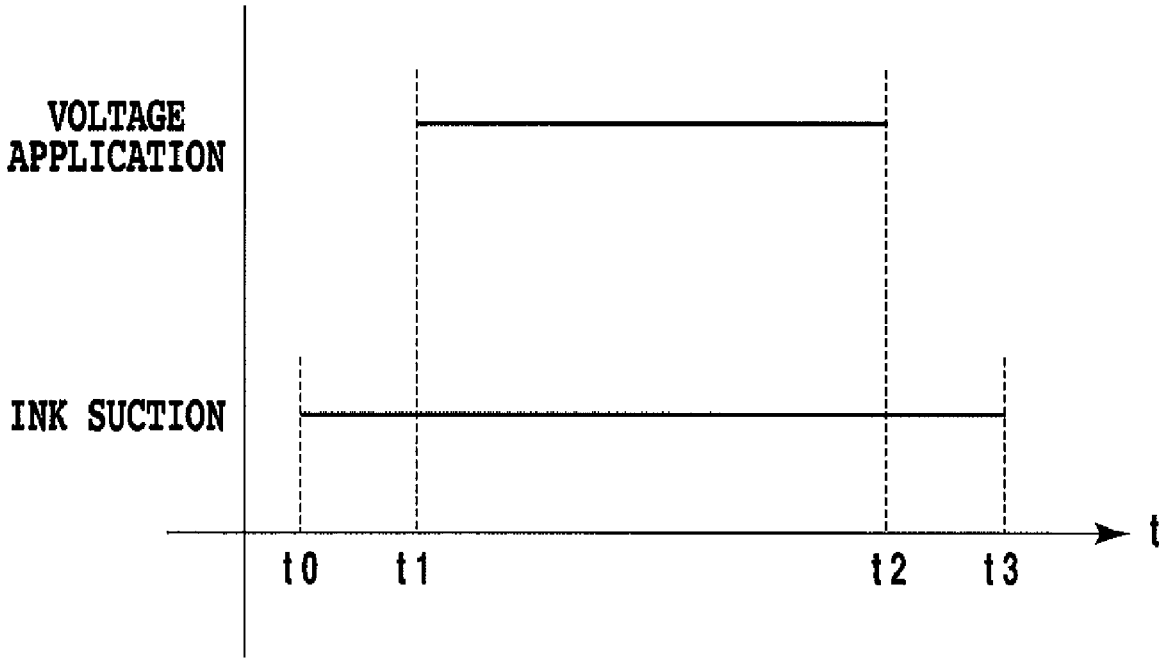
FIG. 24 is a timing diagram showing timings of the electrochemical reaction and the ink discharging operation according to the fourth embodiment of this invention.

Next, a 10-V DC voltage was applied to an external electrode 111 connected to the upper protective layer 107*a* for 30 seconds. At this time, an area 107*a* of the upper protective layer was used as an anode electrode and an area 107*b* as a cathode electrode. Further, as shown in the timing diagram of FIG. 24, before the electrochemical reaction was initiated by applying a DC voltage at t=t1, a suction-based recovery operation using a recovery pump was started at t=t0. Then, by forcibly discharging, along with the ink, the bubbles generated from the voltage application to the upper protective layer 107*a*, the kogation removing operation that involves the dissolving of the upper protective layer 107 was performed up to t2. After the DC voltage application was ended, the suction-based recovery operation was stopped at t3.

Figure 23B:
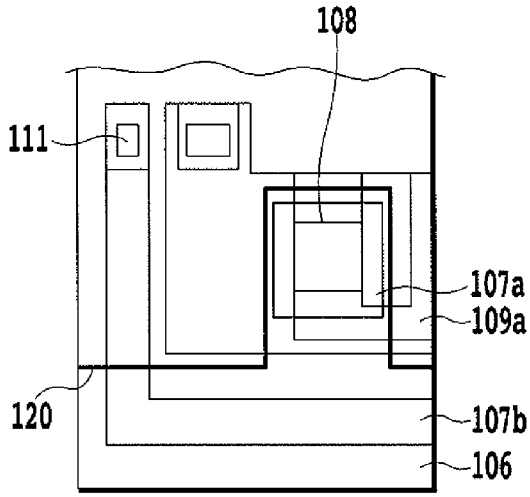
FIG. 23B and FIG. 23C illustrate states of the upper protective layer of the electrothermal transducer according to the fourth embodiment of this invention, showing how a kogation adhering to the upper protective layer is removed by the kogation removing operation in the embodiment of this invention.

As shown in FIG. 23B, it was found that the deposited Kogation K was removed from the heat application portion 108. Performing a printing operation using the ink jet head in this state resulted in a print quality recovering to nearly the initial state.

As can be seen from this result, performing the electrochemical reaction for dissolving the upper protective layer 107 during the ink suction operation can discharge the bubbles generated by the electrochemical reaction along with the ink without the bubbles adhering to the upper protective layer 107. Therefore, even if the ink droplets are as small as less than a few picoliters, the electrochemical reaction between the ink and the upper protective layer 107 is not hindered, allowing the upper protective layer to be dissolved uniformly and reliably. This in turn enables the kogation to be removed even during a long period of use.

Next, to deposit kogation on the heat application portion 108 again after the ink jet head was subjected to the kogation removing operation, the heating portion was energized again under the same condition as described above. Our examination found that the kogation K deposited and the print quality deteriorated.

Then, the same kogation removing operation as described above was conducted. It was found that the deposited kogation K was removed and that the print quality recovered.

(Comparison Example)

Next, after the voltage application for the electrochemical reaction was started, the ink suction operation using the recovery pump was initiated to remove kogation. The ink suction operation was performed until the end of the voltage application.

First, a 20-V drive pulse 1.5 μs wide was applied to the heating portion $5.0\times10^6$ times at a frequency of 5 kHz. As shown in FIG. 23A, an impurity K called kogation was found deposited nearly uniformly on the heat application portion 108. Performing a printing operation using the ink jet head in this state resulted in a degraded print quality because of the deposited kogation K.

Figure 23C:
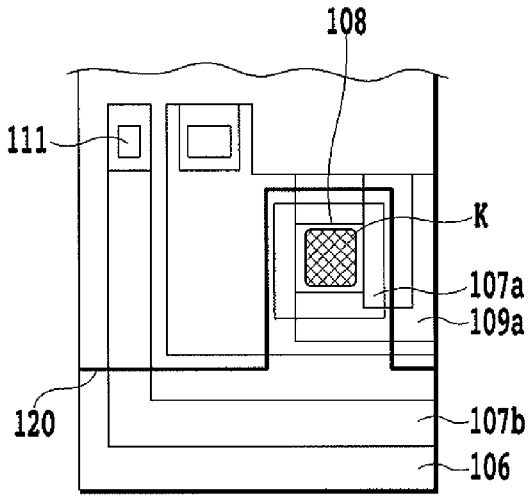

Then, the kogation removing operation was conducted in a way similar to that of the above example 6. Unlike the example 6, the kogation K partly remained deposited, as shown in FIG. 23C.

Figure 23D:
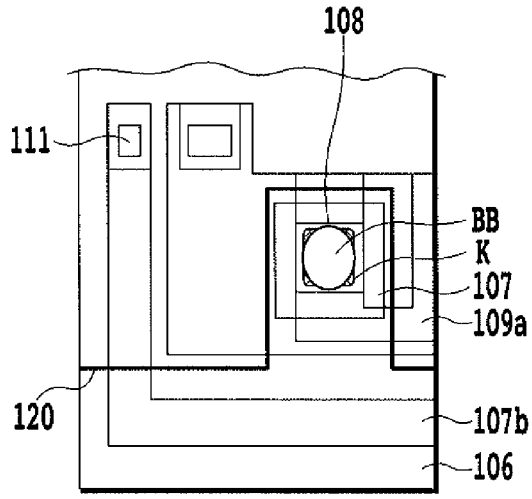
FIG. 23D schematically illustrates a state of the upper protective layer of the electrothermal transducer according to the fourth embodiment of this invention, showing a bubble remaining on a surface of the upper protective layer.

To examine this phenomenon closely, the ink suction operation was stopped during the voltage application and the area of the upper protective layer 107 was observed. As can be seen from FIG. 23D, a bubble BB generated by the electrochemical reaction was found adhering to the upper protective layer 107. This bubble BB is considered to have hindered the electrochemical reaction between the upper protective layer and the ink, failing to remove the kogation from this area. A part of the upper protective layer 107 was not adhered to by the bubble, so the reaction in this area proceeded to remove the kogation from this limited area. However, a portion of the upper protective layer that was in contact with the ink, i.e., the portion where electrochemical reaction was not hindered, was applied concentratedly with the voltage for the electrochemical reaction. So, if the head was used for a long period, it was found that the dissolution of this area of the upper protective layer in the ink would proceed excessively, failing to maintain a uniform thickness of the upper protective layer 107.

Results of the above experiments are shown in Table 4.

TABLE 4

| | Ink suction | Number of ejection pulses (cumulative) | Kogation removing condition | Print qualtiy | Dissolution uniformity |
|---|---|---|---|---|---|
| Example 6 | Before voltage application | Initial stage | — | Good | — |
| | | $5.0\times10^6$ | — | Bad | Good |
| | | — | 10 V, 15 s | Good | |
| | | $1.0\times10^7$ | — | Bad | Good |
| | | — | 10 V, 15 s | Good | |
| Comparison example | After voltage application | Initial stage | — | Good | — |
| | | $5.0\times10^6$ | — | Bad | Bad |
| | | — | 10 V, 15 s | Bad | |

As is seen from the above experiments, in order to assure a uniform and reliable dissolution of the upper protective layer 107, it is appropriate to execute the electrochemical reaction at the same time that the ink suction operation is performed. Particularly when the ink droplet volume is less than a few picoliters, a kogation removing method should be adopted which dissolves the upper protective layer 107 while at the same time discharging the generated bubbles together with the ink without allowing the bubbles to grow to as large a size as will hinder the reaction between the upper protective layer 107 and the ink.

In this embodiment, the suction-based ink ejection performance recovery operation is executed before the electrochemical reaction of the upper protective layer 107 is started, to prevent bubbles generated by the electrochemical reaction from hindering the dissolution reaction and thereby assure a uniform and reliable dissolution of the upper protective layer 107. If t0<t1, as shown in the timing diagram of FIG. 24, the desirable effect of this embodiment is produced. It is generally known that when an electrode material dissolves in a liquid by an electrochemical reaction, a layer called an electric double layer is formed near the electrode surface almost at the same time that the voltage is applied, then the electrochemical reaction proceed. The time it takes for the electric double layer to form is approximately on the order of 0.01 second. So, in the timing diagram of FIG. 24, the effect of the cleaning method of this embodiment can also be obtained when to t0=t1 where t1 represents a time when the voltage application is started and t0 represents a time when the ink suction is started.

6.2 Control Procedure

Figure 25:
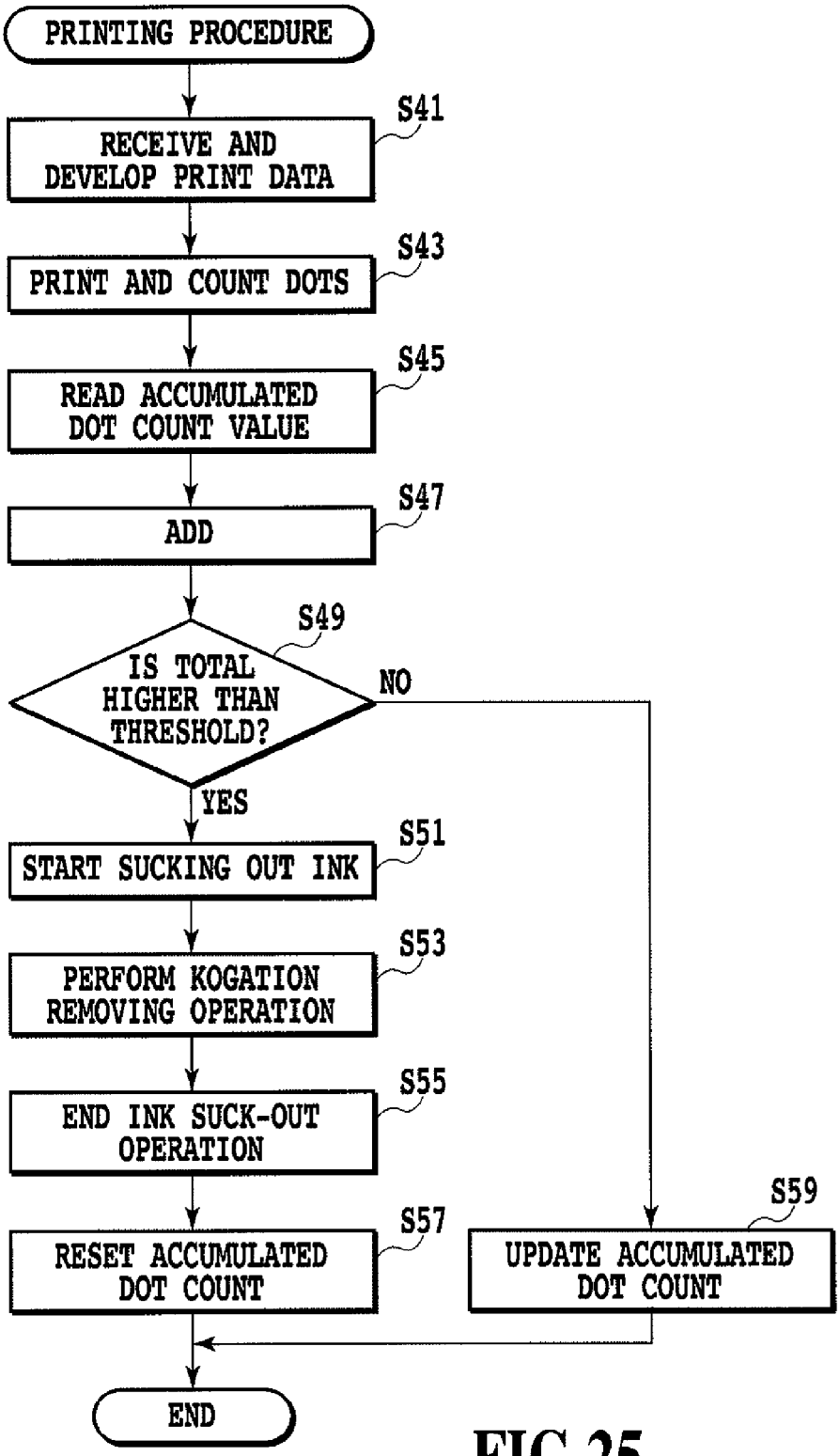
FIG. 25 is a flow chart showing an example printing operation procedure performed by an ink jet printing apparatus according to the fourth embodiment of this invention.
Figure 26:
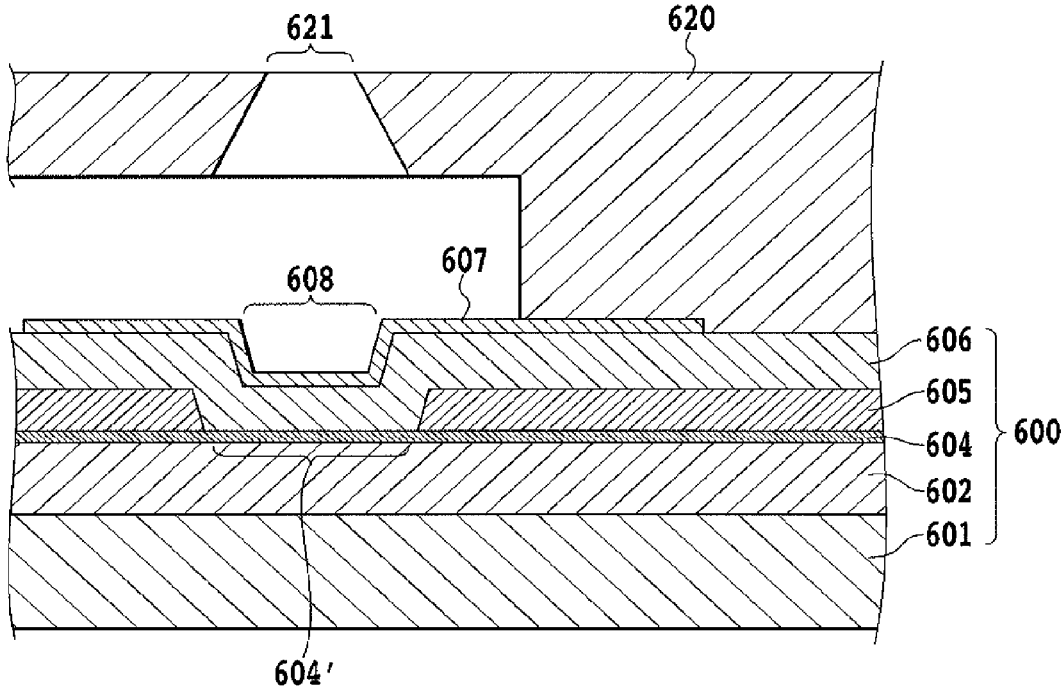
FIG. 26 is a schematic cross-sectional view showing a heat application portion and its surrounding area of a conventional ink jet head.

FIG. 25 shows an example printing procedure that can be performed by a printing apparatus using the cleaning method of this invention.

When the host device 1000 issues a print instruction, the following procedure is initiated. First, the printing apparatus receives image data to be printed from the host device 1000 and develops this image data into print data conforming to the printing apparatus (step S41). Based on the developed print data, the feeding of the print paper P and the main scan of the ink jet head 1 are alternated to perform the printing operation (step S43). At this time, the number of printed dots (the number of drive pulses to the electrothermal transducers) are counted.

Then, when one unit of printing operation (e.g., for one sheet of print paper) is finished, an accumulated data of dot count value stored in the EEPROM 1726 is read out (step S45). To the accumulated dot count value the number of dots just counted is added (step S47). Next, a check is made as to whether the resultant total value is greater than a predetermined threshold value Th (e.g., $5\times10^6$) (step S49).

If the total value is found to be greater than the threshold Th, the recovery operation is started (step S51). Then, a voltage is applied to the upper protective layer 107 to remove kogation on the heat application portion 108 along with the dissolved material of the upper protective layer 107 (step S53). After the kogation removing operation has been conducted, the ink containing the dissolved material of the upper protective layer and the removed kogation stays near the nozzles. If this remaining ink does not have adverse effects on the print quality, the ink may be ejected in the next printing operation. However, in this embodiment the suction-based recovery operation is stopped after the kogation removing operation is finished (step S55) in order to positively discharge the ink containing the dissolved material of the upper protective layer and the removed kogation. After this, the accumulated dot count value stored in the EEPROM 1726 is reset (step S57) before terminating the printing procedure.

If, on the other hand, step S49 determines that the total dot count value does not exceed the threshold, the accumulated dot count value stored in the EEPROM 1726 is updated with the total dot count value (step S59) before ending the printing procedure.

Although in the above procedure the recovery operation and the kogation removing operation are performed after the printing operation, they may be executed prior to the printing operation. In that case, the dot counting is done based on the print data developed by step S41 and this dot count is added to the accumulated dot count value to obtain a total dot count value, which is then used to determine whether or not the kogation removing operation should be executed. It is also possible to perform the kogation removing operation each time a predetermined amount of printing operation is executed (e.g., every one or several scans of the ink jet head).

With this invention, the cleaning operation including the kogation removing operation can be performed during the printing operation, without requiring any additional provision. That is, any special or cumbersome cleaning procedure, such as removing the ink jet head, is obviated, allowing the cleaning operation to be performed efficiently.

In the above fourth embodiment, the polarity of the voltage applied to the upper protective layer may be reversed, as in the third embodiment, for more reliable and improved kogation removing effects.

In the above, as the ink discharging mechanism that discharges ink from the ink path through the nozzles to prevent the clogging of the nozzles, we have explained the suction-based recovery mechanism that sucks out ink from the ink path by a negative pressure. However, this invention may also use an ink discharging mechanism other than the suction-based recovery mechanism. That is, among the ink discharging mechanisms is also known a pressure-based recovery mechanism which applies a pressure (positive pressure) to the ink in the ink path of the ink jet head to forcibly discharge the ink from the nozzles. This pressure-based recovery mechanism is used mainly in ink jet printing apparatus that use a large ink jet head to perform a high-speed printing, such as industrial ink jet printers and full-line type ink jet printers. The present invention is also applicable to the ink discharging operation performed by these pressure-based recovery mechanism and can be expected to produce the similar effects to those produced by the suction-based recovery operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-356314, filed Dec. 9, 2005, Japanese Patent Application No. 2006-262702, filed Sep. 27, 2006 and Japanese Patent Application No. 2006-318864, filed Nov. 27, 2006, which are hereby incorporated by reference herein in their entirety.

What is claimed is:

1. An ink jet printing apparatus comprising:

(a) an ink jet head comprising (1) a circuit board, wherein the circuit board comprises (i) a heating portion formed by a gap of an electrode wiring layer and a heating resistor layer;

(ii) a protective layer formed over the electrode wiring layer and the heating resistor layer; and (iii) an upper protective layer which is arranged over the protective layer and includes at least a heat application portion which contacts an ink and is disposed over the heating portion so that the upper protective layer is configured to serve as an electrode to be electrically connected to cause an electrochemical reaction with the ink, and is made of a material including a metal which is dissolved by the electrochemical reaction and which does not form, on heating, an oxide film which hinders the dissolution; and (2) a flow path forming member having ink ejection orifices each corresponding to the heat application portion, the flow path forming member being joined to the circuit board to form an ink path leading to the ink ejection orifices; and (b) cleaning means for removing kogation deposited on the heat application portion by using the upper protective layer as one electrode to cause the electrochemical reaction and thereby dissolve the upper protective layer in the ink.

2. The circuit board for an ink jet head according to claim 1, wherein the upper protective layer is made of a material containing iridium (Ir) or ruthenium (Ru).

3. The circuit board for an ink jet head according to claim 1, wherein the upper protective layer is formed over the protective layer through a conductive adhesive layer;

wherein the upper protective layer is electrically connected to the electrode wiring layer through the adhesive layer and a through-hole provided in the protective layer.

4. The ink jet printing apparatus according to claim 1, further including a means for discharging the ink after the cleaning operation.

5. The circuit board for an ink jet head according to claim 3, wherein the upper protective layer is arranged in a portion over the adhesive layer, the portion excluding a portion where a flow path forming member for forming an ink flow path is joined to the adhesive layer.

6. The circuit board for an ink jet head according to claim 5, wherein the adhesive layer is made of a material containing a metal which forms, on heating, an oxide film.

7. The circuit board for an ink jet head according to claim 6, wherein the adhesive layer is made of a material containing Ta or Nb.

8. An ink jet head cleaning method for removing kogation deposited on an upper protective layer in an ink jet head, wherein the ink jet head has:

an electrothermal transducer portion arranged in an ink path communicating with an ink ejection orifice, an insulating protective layer to prevent a contact between the electrothermal transducer portion and an ink in the ink path, and an upper protective layer having a heat application portion, the heat application portion covering at least a portion heated by the electrothermal transducer portion of the protective layer, wherein the upper protective layer is formed of a material containing a metal which is dissolved by an electrochemical reaction with the ink and which does not form, on heating, an oxide film which will hinder the dissolution;

the cleaning method comprising a voltage application step of:

using the upper protective layer as one electrode;

using as another electrode a portion configured to electrically connect to the upper protective layer through the ink; and reversing polarities of both of the electrodes when applying a voltage to these electrodes.

9. The ink jet head cleaning method according to claim 8, wherein the voltage application step has a first step of applying a voltage by using the upper protective layer as an anode electrode and the other electrode as a cathode electrode to dissolve in the ink the upper protective layer including the heat application portion by an electrochemical reaction, a second step of applying a voltage by using the upper protective layer as the cathode electrode and the other electrode as the anode electrode to remove a substance composed of an ink component and adhering to the heat application portion, and wherein the first and second step are repetitively performed.

10. The ink jet head cleaning method according to claim 8, wherein the upper protective layer is formed of a material containing Ir or Ru.

11. The ink jet head cleaning method according to claim 8, further including:

a step of, after the voltage application step, discharging ink staying in the ink path from the ink path.

12. The ink jet head cleaning method according to claim 8, wherein the voltage application step is initiated when the number of dots printed by the ink jet head has reached a predetermined number.

13. The ink jet head cleaning method according to claim 8, wherein a threshold of an electric energy to be supplied to the electrothermal transducer portion is measured, and an electric energy corresponding to a measured result is supplied to the electrothermal transducer.

14. An ink jet head cleaning device for removing kogation deposited on an upper protective layer in an ink jet head, wherein the ink jet head having:

an electrothermal transducer portion arranged in an ink path communicating with an ink ejection orifice, an insulating protective layer to prevent a contact between the electrothermal transducer portion and an ink in the ink path, and an upper protective layer having a heat application portion, the heat application portion covering at least a portion heated by the electrothermal transducer portion of the protective layer, wherein the upper protective layer is formed of a material containing a metal which is dissolved by an electrochemical reaction with the ink and which does not form, on heating, an oxide film which will hinder the dissolution;

the cleaning device comprising:

a voltage application means for applying a voltage between an electrode configured to electrically connect to the upper protective layer and the upper protective layer;

wherein the voltage application means has a voltage reversing means which reverses a polarity of the upper protective portion when applying the voltage between the heat application portion and the electrode.

15. The ink jet head cleaning device according to claim 14, wherein the voltage reversing means comprises a switching device connected to the upper protective portion and the electrode.

16. The ink jet head cleaning device according to claim 14, wherein the voltage reversing means is provided in the ink jet head.

17. An ink jet head comprising:

an electrothermal transducer portion arranged in an ink path communicating with an ink ejection orifice;

an insulating protective layer to prevent a contact between the electrothermal transducer portion and an ink in the ink path;

an upper protective layer having a heat application portion, the heat application portion covering at least a portion heated by the electrothermal transducer portion of the protective layer, wherein the upper protective layer is formed of a material containing a metal which is dissolved by an electrochemical reaction with the ink and which does not form, on heating, an oxide film which will hinder the dissolution;

an electrode configured to electrically connect to the upper protective layer application portion through the ink; and a reversing means for reversing a polarity of the heat application portion when applying the voltage between the heat application portion and the electrode.

18. An ink jet printing apparatus using an ink jet head for printing, wherein the ink jet head has:

an electrothermal transducer portion arranged in an ink path communicating with an ink ejection nozzle, an insulating protective layer to prevent a contact between the electrothermal transducer portion and an ink in the ink path, and an upper protective layer having a heat application portion, the heat application portion covering at least a portion heated by the electrothermal transducer portion of the protective layer, wherein the upper protective layer is formed of a material containing a metal which is dissolved by an electrochemical reaction with the ink and which does not form, on heating, an oxide film which will hinder the dissolution;

the ink jet printing apparatus comprising:

a cleaning means for removing kogation deposited on the upper protective layer by using the heat application portion as one electrode and, as another electrode, a portion configured to electrically connect to the upper protection layer portion through the ink and by reversing polarities of both of the electrodes when applying a voltage.

* * * * *